US008401433B2

(12) United States Patent
Bucks et al.

(10) Patent No.: US 8,401,433 B2
(45) **Date of Patent: *Mar. 19, 2013**

(54) METHODS FOR DUAL DRIVE OPERATION OF AN AUGER IN A DEVELOPMENT STATION

(75) Inventors: Rodney R. Bucks, Webster, NY (US); Arun Chowdry, Pittsford, NY (US); Alan E. Rapkin, Pittsford, NY (US); Donald S. Rimai, Webster, NY (US); Eric C. Stelter, Pittsford, NY (US)

(73) Assignee: Eastman Kodak Company, Rochester, NY (US)

( * ) Notice: Subject to any disclaimer, the term of this patent is extended or adjusted under 35 U.S.C. 154(b) by 289 days.

This patent is subject to a terminal disclaimer.

(21) Appl. No.: 12/893,177

(22) Filed: Sep. 29, 2010

(65) Prior Publication Data

US 2012/0076541 A1 Mar. 29, 2012

(51) Int. Cl.
*G03G 15/08* (2006.01)

(52) U.S. Cl. ..... 399/256

(58) Field of Classification Search ..... 399/254, 399/256

See application file for complete search history.

(56) References Cited

U.S. PATENT DOCUMENTS

| | | | |
|---|---|---|---|
| 5,559,581 | A | 9/1996 | Sugiura et al. |
| 7,024,137 | B2 | 4/2006 | Nittani |
| 7,079,793 | B2 | 7/2006 | Amano et al. |
| 7,215,909 | B2 | 5/2007 | Nittani |
| 7,577,383 | B2 | 8/2009 | Brown et al. |
| 7,580,657 | B2 | 8/2009 | Tateyama et al. |
| 7,627,271 | B2 | 12/2009 | Ookushi et al. |
| 7,669,496 | B2 | 3/2010 | Takahashi |
| 2010/0272473 | A1 * | 10/2010 | Yoshii ..... 399/254 |

OTHER PUBLICATIONS

Goodman Conveyor Company, Screw Conveyor 101, Section 4, Seals, End Bearings, and Thrust Bearings, pp. 1-17, 1999.

Goodman Conveyor Company, Screw Conveyor 101, Section 7, Shafts and Coupling Bolts, pp. 1-7, 1999.

* cited by examiner

*Primary Examiner* — Quana M Grainger

(74) *Attorney, Agent, or Firm* — Roland R. Schindler, II

(57) ABSTRACT

Methods for operating a development station are provided. In one aspect a method comprises the steps of: applying a first force at a first end of an auger and a second force at a second end of the auger with the first force and the second force being sufficient to rotate the auger against a drag exerted by the developer and the replenishment toner. Both the first force and the second force are less than a third force applied to a single driven end of an alternative auger to rotate the alternative auger against the drag and wherein the auger has a first yield strength at the first end and a second yield strength at the second end that are less than a third yield strength required to receive the third force at the driven end of the alternative auger.

25 Claims, 19 Drawing Sheets

METHODS FOR DUAL DRIVE OPERATION OF AN AUGER IN A DEVELOPMENT STATION

CROSS REFERENCE TO RELATED APPLICATIONS

This application relates to commonly assigned, copending U.S. application Ser. No. 12/893,184, filed Sep. 29, 2010, entitled: "DEVELOPMENT STATION WITH DUAL ACTUATOR DRIVE"; U.S. application Ser. No. 12/893,117, filed Sep. 29, 2010, entitled: "DEVELOPMENT STATION WITH DUAL DRIVE"; U.S. application Ser. No. 12/893,209, filed Sep. 29, 2010, entitled: "METHOD FOR OPERATING DEVELOPMENT STATION AUGER", and U.S. application Ser. No. 12/893,220, entitled: "DEVELOPMENT STATION WITH AUGER TENSIONING", filed Sep. 29, 2010 each of which are hereby incorporated by reference.

FIELD OF THE INVENTION

The present invention relates to electrostatography, including electrography and electrophotography, and more particularly to development stations used in electrostatography.

BACKGROUND OF THE INVENTION

As is well known, electrostatographic printers and copiers form toner images on a primary imaging member, transfer the toner images onto a receiver and fuse the toner images to the receiver. In practice, the primary imaging member has a photoconductor surface on which the toner is applied by the sequential steps of uniformly charging the photoconductor exposing the uniformly charged photoconductor to a pattern of light that causes a portion of the uniform charge on the photoconductor to discharge leaving a latent electrostatic image on the photoconductor.

The latent electrostatic image is then exposed to charged toner particles. Electrostatic fields between the primary imaging member and a surface carrying the developer to the exposure window cause the charged toner particles to transfer onto to the primary imaging member according to the pattern and intensity of the electrostatic latent electrostatic image on the photoconductor. The toner image formed on the photoreceptor is then transferred to a receiver by pressing the receiver and the toner image against each other. It is generally preferred to simultaneously apply an electrostatic field to urge the toner particles to the receiver while pressing the receiver against the toner image-bearing primary imaging member.

In some electrophotographic systems the transfer of the toner image is made directly from the primary imaging member to the receiver, however in other electrophotographic systems, the toner image is first transferred from the primary imaging member to an intermediate transfer member and the toner image is subsequently transferred from the intermediate transfer member to a final receiver. The toned receiver is then moved to a fusing station where the toner image is fused to the receiver by heat and/or pressure.

The toner used in electrostatographic systems often takes the form of pigmented thermoplastic particles. In most electrostatographic systems, a process known as tribocharging is used to impart a charge on the pigmented thermoplastic particles. For example, an electrostatographic system that uses a two part developer having toner particles that are mixed with and carried by somewhat larger particles of magnetic material the tribocharging process is performed by mixing the toner particles and magnetic material together. During mixing the magnetic carrier particles interact with the toner particles to impart a generally uniform level of charge on the toner particles so that the toner particles will transfer to the primary imaging member in proportion to of the latent charge image on the photoreceptor.

Thus, it will be appreciated that, as multiple charge images are developed in this manner, toner particles are continuously depleted from the two part developer and that the two part developer must be replenished with fresh toner from time-to-time in order to maintain a concentration of charged toner necessary to provide desired density levels of toner on the primary imaging member. Accordingly, such replenishment toner must be mixed into the developer both to tribocharge the replenishment toner and to provide at least a minimum concentration of charged toner for development. In an electrophotographic printer, the task of mixing toner with carrier to tribocharge the toner and to provide at least a minimum toner concentration is performed by what is known as a development station.

In many electrostatographic printers, the replenishment toner is supplied to the development station from a toner supply bottle that is mounted upside-down i.e., with its mouth facing downward, at one end of the image-development apparatus. Under the force of gravity, toner accumulates at the bottle mouth and a metering device, positioned adjacent the bottle mouth, operates to meter sufficient toner to the developer mix to compensate for the toner lost as a result of image development. Usually, the toner-metering device operates under the control of a toner concentration monitor that continuously senses the ratio of toner to carrier particles in the development mix.

In a typical development station, a housing comprises a sump that contains the developer. The developer is fed to a toning roller that transports the developer into close proximity to the primary imaging member. After toning the primary imaging member, the depleted developer is stripped from the toning roller and transported back into the sump, where it is mixed with fresh developer and, when necessary, the developer is replenished with additional toner to replace the toner that had been deposited onto the primary imaging member. The replenishment toner is introduced into the recirculating developer path and mixed therewith to ensure a uniform toner concentration throughout the developer. To accomplish the mixing, replenishment, feeding and stripping of the development roller, at least one auger is used to advance and to optionally mix any replenishment toner into the developer as the developer is moved through the development system.

The augers used in a development station typically comprise a shaft and have one or more flights of ribbons. The developer exerts significant drag on the augers during rotation. Accordingly, high torques are applied to the augers to overcome this drag.

Another problem caused by the drag exerted by the developer on an auger is that this drag can cause the auger to flex perpendicular to an axis of rotation. This flexing perpendicular to an axis of rotation can cause pinch points with side walls of the chamber or housing of a development station within which the auger is located wherein the developer can be compressed between the auger and the chamber walls. This flexing further increases drag on the auger and can cause agglomerates to form in the developer. This flexing of the auger can also cause another type of drag that occurs when the auger flexes to an extent that allows the auger to rub against side walls of the chamber or housing of a development station within which the auger is located.

It will be appreciated therefore that while it is advantageous to be able to make small, light development stations it is often necessary to make augers larger to accommodate the drag forces when light weight materials are used for auger fabrication, for example, the Xerox 7500 printer sold by Xerox Corp., Rochester, N.Y., USA uses a low density plastic material to fabricate an auger with a relatively large shaft and auger. However, as the size of an auger increases, and, in particular, as the radius or diameter of the auger shaft increases, the auger itself occupies a larger volume of the development station, typically requiring a concomitant increase in the volume of the development station itself. Further, it will be appreciated that when augers are made larger, the size, cost and power of the equipment used to control operation of the auger will increase. Accordingly, the amount of space occupied by a development station that uses such an auger and control equipment can be quite large.

Conversely, smaller stations can be made using comparatively dense materials such as metals to fabricate the augers for example, the RICOH C6000 printer sold by Ricoh, Japan, uses a metal auger. This creates smaller but heavier development stations and requires more complex and costly auger fabrication techniques.

Further, it is known that in some development stations, the task of ensuring that the desired mixing of replenishment toner and developer can be problematic. In such stations, the mixing and transport are often enhanced using paddles. Such paddles increase drag, add cost to an auger, require an increase in the shaft size of the auger, and can create additional pinch points which further increase drag.

Yet another problem created by the drag is that the drag creates loads that cause the auger to translate backwards and forwards along its axis of rotation during rotation. This can also create agglomerates and set up waves of different concentrations of developer flow within a developer during exposure that will result in image density variations in a toner image formed during such exposure.

What is needed in the art therefore are new development stations and methods for operating development stations that allow for smaller equipment size while providing a consistent amount of developer to the primary imaging member and that can more effectively deal with the problems created by toner and developer drag on an auger.

SUMMARY OF THE INVENTION

Methods for operating a development station are provided. In one aspect, the methods comprise the steps of applying a first force at a first end of an auger and a second force at a second end of the auger with the first force and the second force being sufficient to rotate the auger against a drag exerted by the developer and the replenishment toner. Both the first force and the second force are less than a third force applied to a single driven end of an alternative auger to rotate the alternative auger against the drag and wherein the auger has a first yield strength at the first end and a second yield strength at the second end that are less than a third yield strength required to receive the third force at the driven end of the alternative auger.

DETAILED DESCRIPTION OF THE INVENTION

The present description will be directed in particular to elements forming part of, or in cooperation more directly with the apparatus in accordance with the present invention. It is to be understood that elements not specifically shown or described may take various forms well known to those skilled in the art.

Figure 1:
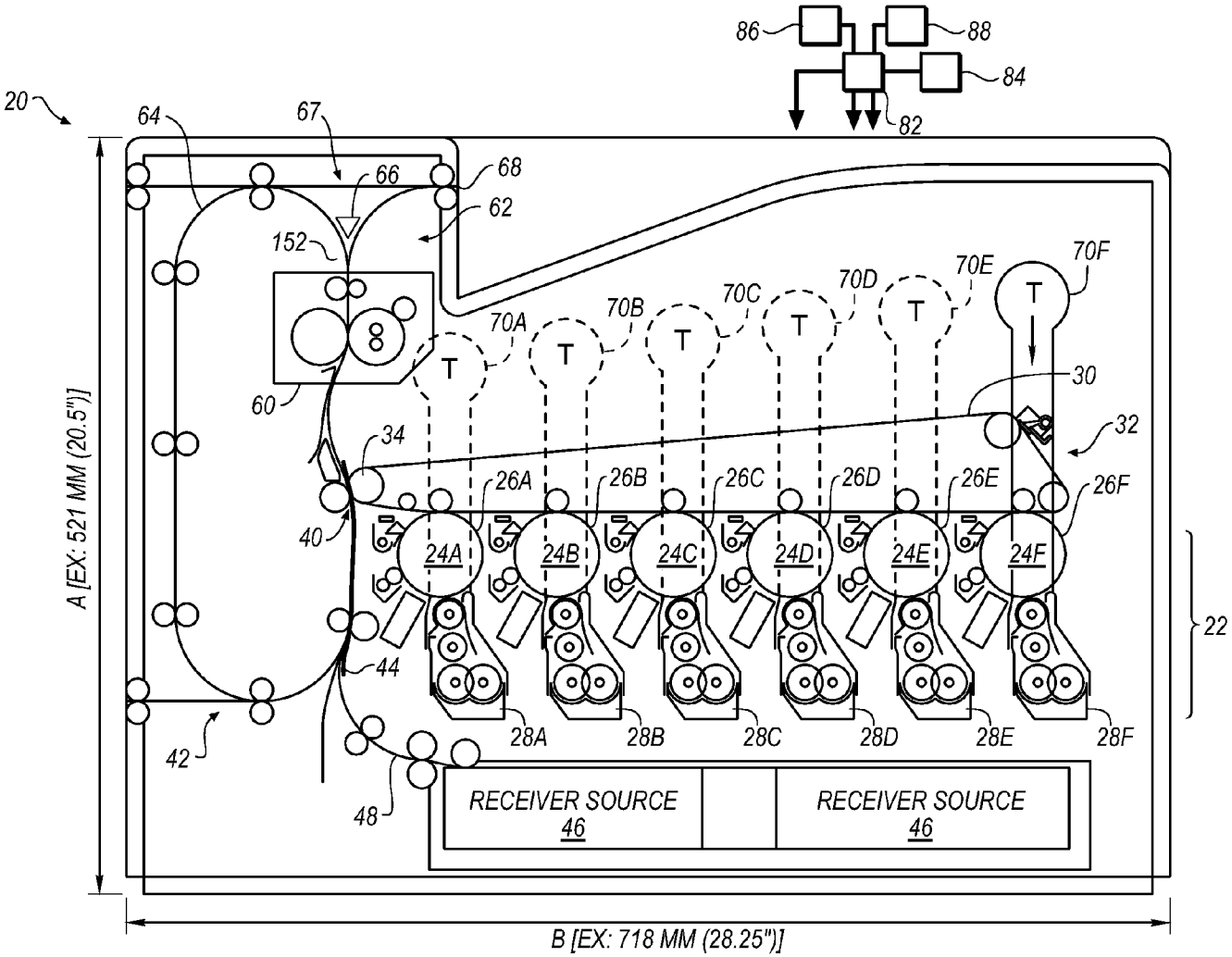
FIG. 1 is a cross-sectional view of one embodiment of an electrophotographic printer.

FIG. 1 shows an electrophotographic (EP) printer 20 having a print engine 22 for recording toner images on an intermediate transfer member (ITM) 30 and an intermediate transport system 32 with at least one intermediate transport motor 34 for moving intermediate 30 past print engine 22 and to a transfer nip 40. Print engine 22 forms a multi-toner image on ITM 30 by sequentially transferring single toner images in registration on ITM 30 as ITM 30 is moved past print engine 22. A receiver transport system 42 moves a receiver 44 along a receiver path 48 from a receiver source 46 through transfer nip 40 so the multi-toner image is transferred from ITM 30 to receiver 44. Receiver transport system 42 then moves receiver 44 and the transferred multi-toner image through a fuser 60 to fuse, fix or sinter the transferred multi-toner image to receiver 44.

EP Printer 20 is controlled by a printer controller 82 which can take the form of a microprocessor, microcontroller or other such device which controls EP printer 20 based on signals from a user input system 84, appropriate sensors 86 of conventional design and an optional data communication system which can comprise any type of electronic system that can receive information that can be during printing operations by printer controller 82. EP Printer 20 uses actuators and other circuits and systems 88 that enable printer controller 82 to exert physical control over particular operations EP printer 20 is shown having dimensions of A×B which are around in one example, 521×718 mm or less, however, it will be appreciated that such dimensions are exemplary and are not limiting.

As is shown in the embodiment of FIG. 1, print engine 22 has a plurality of electrophotographic modules 24A, 24B, 24C, 24D, 24E, and 24F that are provided in tandem and that transfer the various layers of toner necessary to form the multi-toner image. In this embodiment each electrophotographic module 24A, 24B, 24C, 24D, 24E, and 24F has, respectively, a primary imaging member 26A, 26B, 26C, 26D, 26E, and 26F, and a development station 28A, 28B, 28C, 28D, 28E, and 28F that provides toner for developing latent electrostatic images on transfer primary imaging member 26A.

Generally, toner takes the form of toner particles formed from a material or mixture of materials that can be charged and electrostatically attracted from a development station 28A-28F to a primary imaging member 26A-26F to form an image, pattern, or coating on an appropriately charged primary imaging member including a photoreceptor, photoconductor, electrostatically-charged, magnetic or other known type of primary imaging surface. Method and systems for imparting the charge pattern are well known to those of skill in the art. Toner is used in an electrophotographic print engine 22 to convert an electrostatic latent image into a toner image on primary imaging members 26A-26F respectively.

Toner particles can have a range of diameters, e.g. less than 8 μm, on the order of 10-15 μm, up to approximately 30 μm, or larger. When referring to particles of toner, the toner size or diameter is defined in terms of the median volume weighted diameter as measured by conventional diameter measuring devices such as a Coulter Multisizer, sold by Coulter, Inc. The volume weighted diameter is the sum of the mass of each toner particle multiplied by the diameter of a spherical particle of equal mass and density, divided by the total particle mass. Toner is also referred to in the art as marking particles or dry ink. In certain embodiments, toner can also comprise particles that are entrained in a wet carrier.

Color toner particles typically have optical densities such that a monolayer coverage (i.e. sufficient application of marking particles such that a microscopic examination would reveal a layer of marking particles covering between 60% and 100% of a primary imaging member) would have a transmission density of between 0.6 and 1.0 in the primarily absorbed light color (as measured using a device such as an X-Rite Densitometer with Status A filters). However, it will be appreciated that these transmission densities are exemplary only and that any conventional range for transmission density or reflectivity can be used with the color toner particles.

Toner can also include clear particles that have the appearance of being transparent or that while being generally transparent impart a coloration or opacity. Such clear toner can provide for example a protective layer on an image and, optionally, on unprinted portions of receiver 44 or can be used to create other effects and properties.

The various electrophotographic modules 24A-24F form toner images using one type of toner and they can be used in various combinations as desired to print different types of images or to achieve other effects. In the embodiment of print engine 22 shown in FIG. 1 six electrophotographic modules 24A, 24B, 24C, 24D, 24E and 24F enable six different toner images to be applied to ITM 30 enabling, for example, six different types of toner to be applied in various combinations.

For example, in one application, modules 24A, 24B, 24C, 24D supply toner particles of one of the subtractive primary colors. These primary subtractive colors can be applied in various combinations to create images having a full gamut of colors, thus allowing fifth and sixth electrophotographic modules 24E and 24F to be used to deliver additional toner types. These additional toner types can include, but are not limited to toner particles that include different subtractive toner colors, clear toner, raised print, MICR magnetic characters, as well as specialty colors and metallic toners and can deliver toners that are not produced with the basic four subtractive color marking particles. In this example, fifth electrophotographic module 24E and sixth electrophotographic module 24F can deliver a clear toner in a first layer as an overcoat material and in a second layer to form raised textures above the overcoat layer. Here too, it will be understood that these examples are not limiting as fifth electrophotographic module 24E and sixth electrophotographic module 24F can deliver any known type of toner as may be useful or required.

In one example, user input system 84 can sense a selection that is made by an individual operating or owning (hereafter referred to as the operator) an EP printer 20 and can provide control signals to printer controller 82 that printer controller 82 can use to determine whether to apply specialty toner particles to a multi-toner image and where to apply these specially toner particles in order to achieve a particular print outcome. Similarly, printer controller 82 can determine which specialty toner to apply to an image and where to apply such specialty toner based upon analysis of the image data or print instructions associated with an image to be printed.

It will be appreciated that the organization of toner types with respect to particular electrophotographic modules 24A-24F shown in FIG. 1 is provided by way of example and is not limiting.

In the embodiment that is illustrated in FIG. 1, each toner image is transferred, in register, from one of the primary imaging members 24A-24F to ITM 30 to form a multi-toner image. Methods and systems for imparting the charge pattern are well known to those of skill in the art. ITM 30 can be in the form of a continuous web as shown or can take other forms such as a drum or sheet. It is preferable to use a compliant intermediate transfer member, such as described in the literature, but ITM 30 can also take a non-compliant form.

The multi-toner image formed on ITM 30 is transferred to a receiver 44 when receiver 44 passes through transfer nip 40 in registration with a portion of ITM 30 having the multi-toner image. In the embodiment that is illustrated in FIG. 1, receiver 44 is provided in the form of receiver sheets that are held in EP printer 20 at receiver source 46. However, in other embodiments, receiver 44 can be provided on rolls or in other forms that can be supplied form receiver source 46.

Receiver 44 enters a receiver path 48 from receiver source 46 and travels initially in a counterclockwise direction through receiver path 48. Alternatively, receiver 44 could also be manually input from the left side of the electrophotographic printer 20. The multi-toner image is transferred from ITM 30 to receiver 44 and multi-toner image bearing receiver 44 then passes through a fuser 60 where multi-toner image is fixed to receiver 44.

Receiver 44 then enters a region where receiver 44 either enters an inverter 62 or continues to travel counterclockwise through a recirculation path 64 that returns receiver 44 to receiver path 48 such that receiver 44 will pass through transfer nip 40 and fuser 60 again.

A return area 67 is provided that allows receiver 44 to first enter inverter 62 before being moved through return area 67 to reenter recirculation path 64 so that receiver 44 travels clockwise, stops, and then travels counterclockwise back through recirculation path 64 to receiver path 48. This inverts receiver 44, thereby allowing an image to be formed on both sides of receiver 44 to provide a duplex print. Prior to inverter 62 is a diverter 66 that can divert receiver 44 from inverter 62 and send receiver 44 along recirculation path 64 in a counterclockwise direction.

Recirculation of a non-inverted receiver 44 allows multiple passes on a same side of receiver 44 as might be desired if multiple layers of marking particles are used in the image or if special effects such as raised letter printing using large clear toner are to be used. Operation of diverter 66 to enable a repeat of simplex and duplex printing can be visualized using the recirculation path 64.

It should be noted that, if desired, fuser 60 can be disabled so as to allow a simplex image to pass through fuser 60 without fusing. This might be the case if an expanded color balance in simple printing is desired and a first fusing step might compromise color blending during the second pass through the EP engine. Alternatively, a fuser 60 that tacks or sinters, rather than fully fuses an image and is known in the literature can be used if desired, such as when multiple simplex images are to be produced.

Optionally, an image bearing receiver 44 can also be processed by a post-fusing glosser (not shown) that imparts a high gloss to the image, as is known in the art.

Development Station

Figure 2:
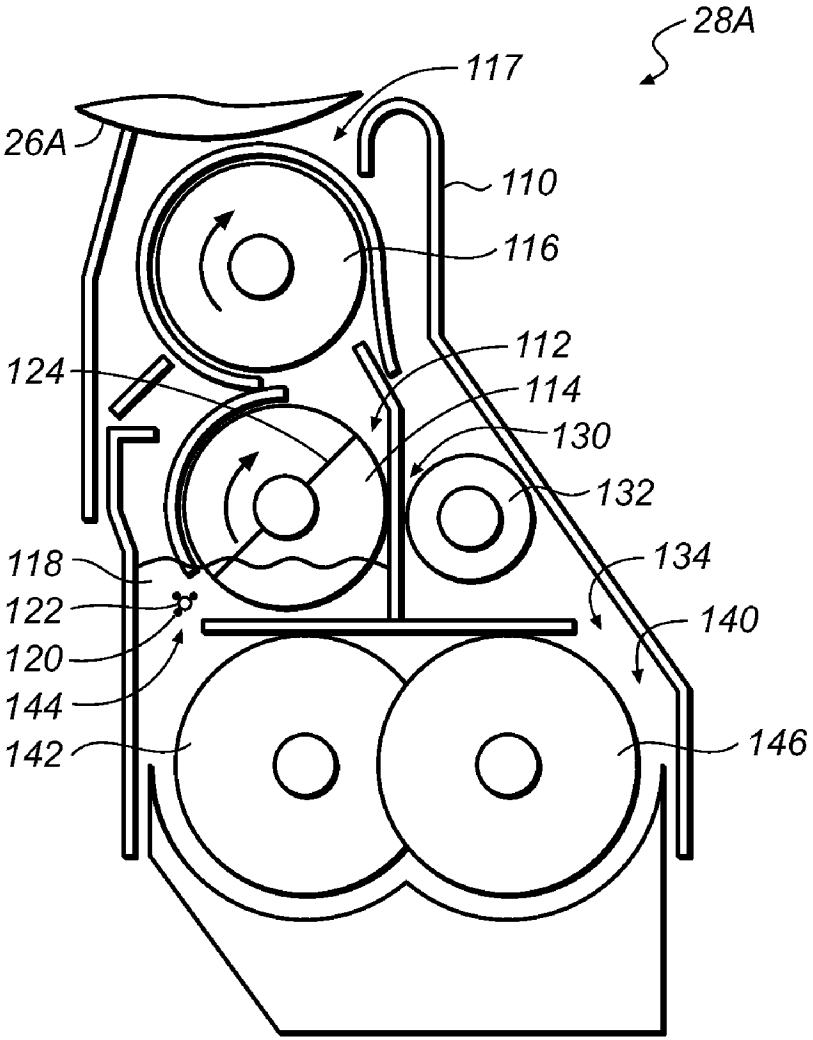
FIG. 2 is a transverse cross-sectional view of a development station for an electrophotographic printer.

FIGS. 2 and 3 provide a first detailed example embodiment of a development station 28A. FIG. 2 is a transverse cross-sectional view of development station 28A, while FIG. 3 is a longitudinal cross-sectional schematic view of one embodiment of development station 28A of FIG. 2 showing the directional flow of toner in development station 28A.

As is commonly understood in electrophotographic printers, development stations 28A-28F are used to create a supply of charged toner particles that can be exposed to an electrostatic field on a primary imaging member (PIM) 26A such that toner can be attracted to PIM 26A according to the intensity and pattern of the electrostatic image formed on PIM 26A. Charge is typically applied to such toner particles by a tribocharging process in which toner particles are mixed with other particles in a manner that imparts a charge on the toner particles.

In this embodiment, development stations 28A-28F process two component developers such as those containing both toner particles and magnetic carrier particles. Accordingly, development stations 28A-28F are of the type that can deliver two component developer using a rotating magnetic core, a rotating shell around a fixed magnetic core, or a rotating magnetic core, a rotating magnetic shell or a development roller 116 to expose the toner and magnetic carrier to the image wise charged PIM 26A-26F associated therewith. During this exposure, toner is drawn from the toner/carrier mix and onto the PIM 34 and subsequently transferred to ITM 30. This toner must replaced at least to an extent necessary to provide a range of toner concentration in the mix that does not detract from the density or apparent density of the toner image that is formed on ITM 30.

It is therefore a function of development stations 28A-28F to replenish the toner in developer 118 after use to an extent that is sufficient to prevent depletion artifacts from forming in an image and to maintain the density of the image. Replacement toner particles are added to the development stations 28A-28F by replenishment stations 70A-70F, each of which contains a toner type of the toner being used in development stations 28A-28F, respectively.

As is shown in FIG. 2, development station 28A comprises a housing 110 having a first channel 112 with a feed auger 114. A development roller 116 is adjacent feed auger 114 and is also adjacent a development window 117. The cross-sectional view of FIG. 2 shows a low volume of developer 118 containing magnetic particles and toner particles 120 (not to scale) in first channel 112. In FIG. 2, toner particles 120 are represented schematically as a filled-in circles and magnetic particles 122 as an unfilled circle. As is shown in the embodiment of FIG. 2, feed auger 114 optionally incorporates two of a plurality of paddles 124 to facilitate developer movement as will be described in general in greater detail below.

In operation, developer 118 is fed from first channel 112 to development roller 116. Development roller 116 moves developer 118 to exposure window 117 where developer 118 is positioned in proximity with primary imaging member 26A. A portion of toner 120 in developer 118 exposed to development roller 116 is transferred onto primary imaging member 26A as a product of electrostatic attraction caused by electrostatic patterns applied to primary imaging member 26A by a writer (not shown) of conventional design. After exposure, the developer is moved by developer roller 116 away from exposure window 117 and drops into second channel 130. A return auger 132 is in second channel 130 to collect any developer 118 that enters second channel 130 and to direct developer 118 to an opening 134 at the rear of housing 110 where developer 118 collected by second channel 130 is dropped into third channel 140. At least one mixing auger 142 is provided in third channel 140 to move developer 118 to a passageway 144 at the front of housing 110, where this developer 118 is fed to feed auger 114 in first channel 112. As is illustrated here, third auger 142 is optionally assisted by a second mixing auger 146.

Figure 3A:
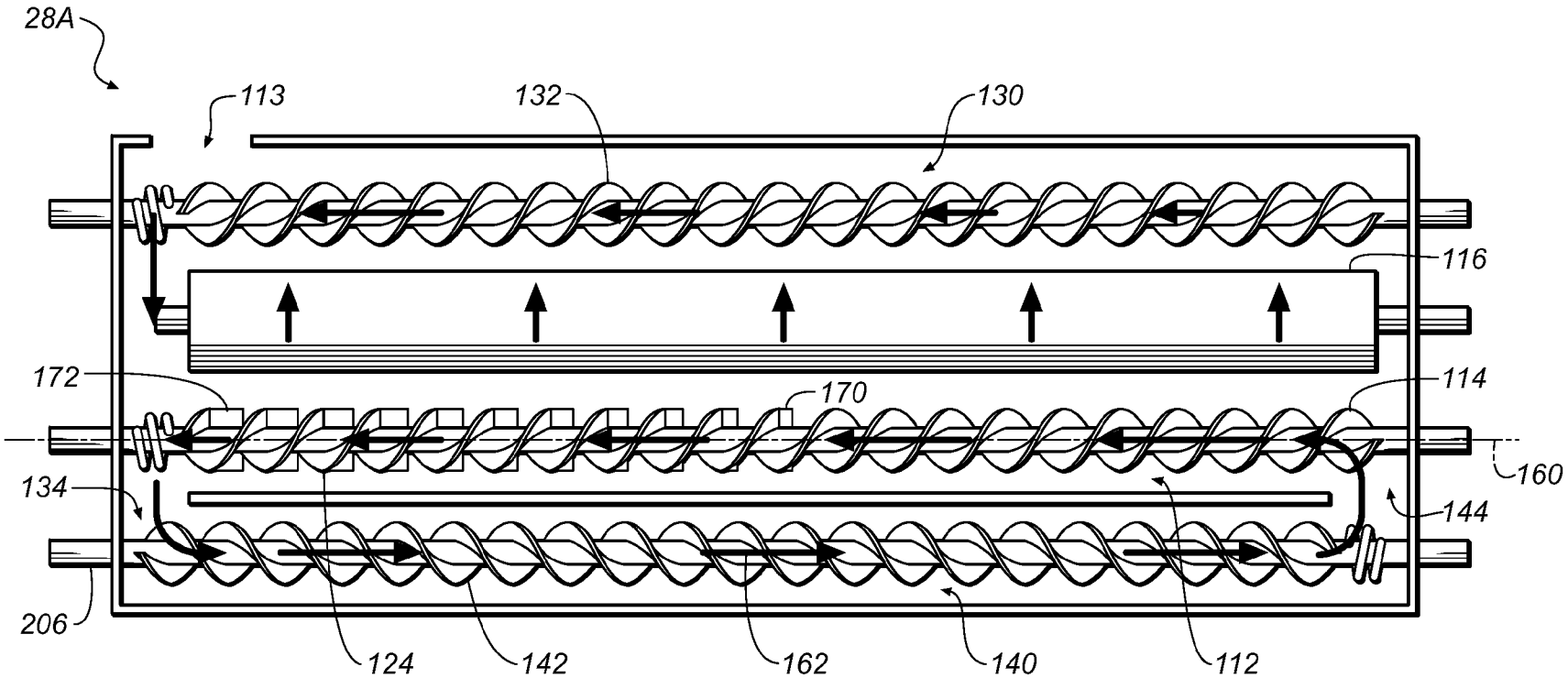
FIG. 3A is a longitudinal cross-sectional schematic view of one embodiment of the development station of FIG. 2 showing the directional flow of toner with an opening in a first location.

FIG. 3A is a longitudinal cross-sectional schematic view of the development station 28A of FIG. 2 illustrating developer flow in development station 28A. As is shown in FIG. 3A, there is a decreasing volume of developer in first channel 112 along an axis 160 of feed auger 114. In FIG. 3 this is indicated by the decreasing length of the arrows 162 in the direction of developer flow indicated by the arrow direction. Uniform flow of developer over development roller 116 is indicated by similar arrows of the same size. Increasing volume of developer in second channel 130 is indicated by the increasing length of the arrows in the direction of developer flow. The arrows also indicate that developer from first channel 112 and second channel 130 is collected in the third channel 140, where this developer is mixed with additional toner from toner source 70A (as shown in FIG. 1) and fed from an opening 113. As is shown in FIG. 3A, opening 113 provides additional toner to replenish toner concentrations in developer that has been exposed at exposure window 117 as this developer is going into the downstream end of the return auger. This allows the additional toner to be added to the depleted developer as the depleted developer is being combined with the surplus developer from feed auger 114 at the downstream end of feed auger 114 and allowing the combination to fall into the upstream end of the mixing auger 142, which in this embodiment is proximate to first end 206 of mixing auger 142.

Figure 3B:
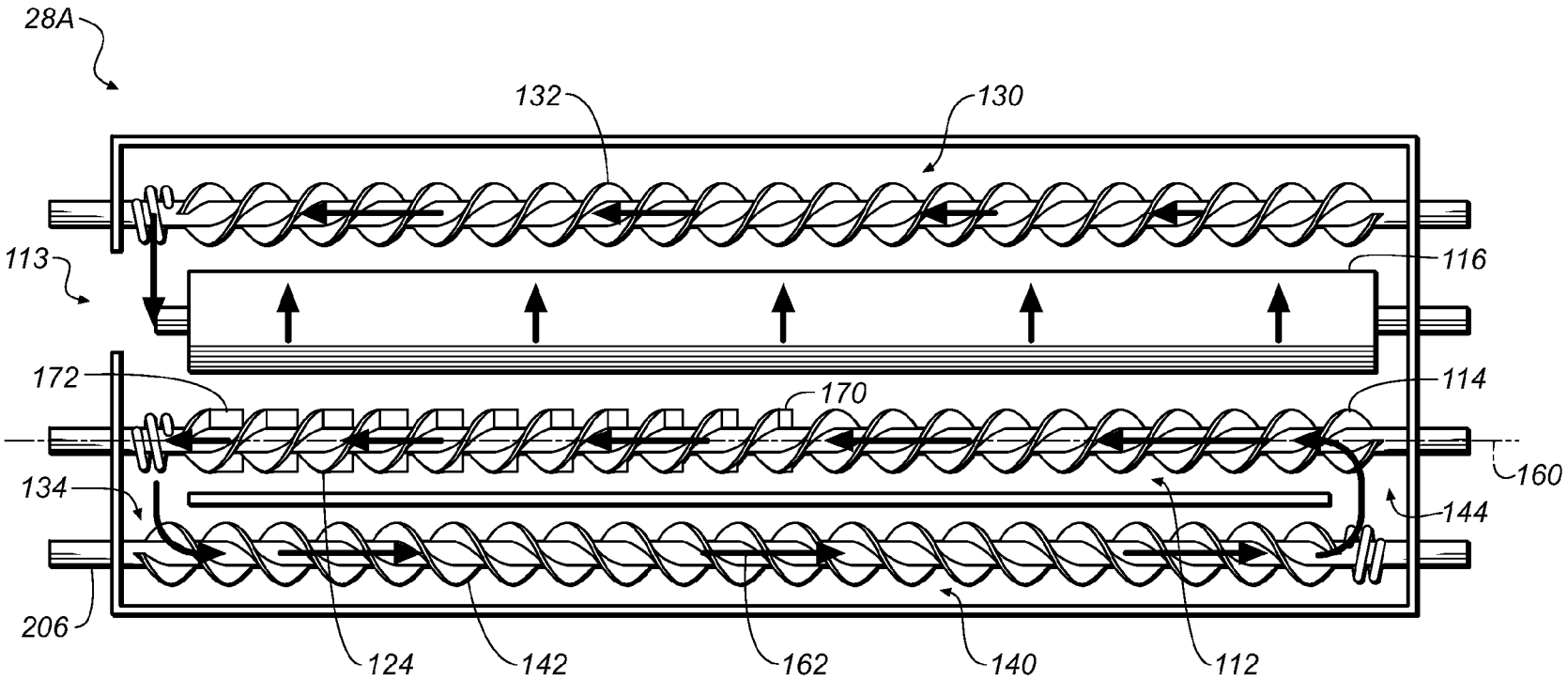
FIG. 3B is a longitudinal cross-sectional schematic view of one embodiment of the development station of FIG. 2 showing the directional flow of toner with an opening in a second location.

FIG. 3B shows another embodiment of a development station 28A with opening 113 located where the surplus developer from feed auger 114 and the depleted developer from the return auger are combined and transferred to an upstream end of mixing auger 142 which in this embodiment is proximate to first end 206 of mixing auger 142.

Figure 3C:
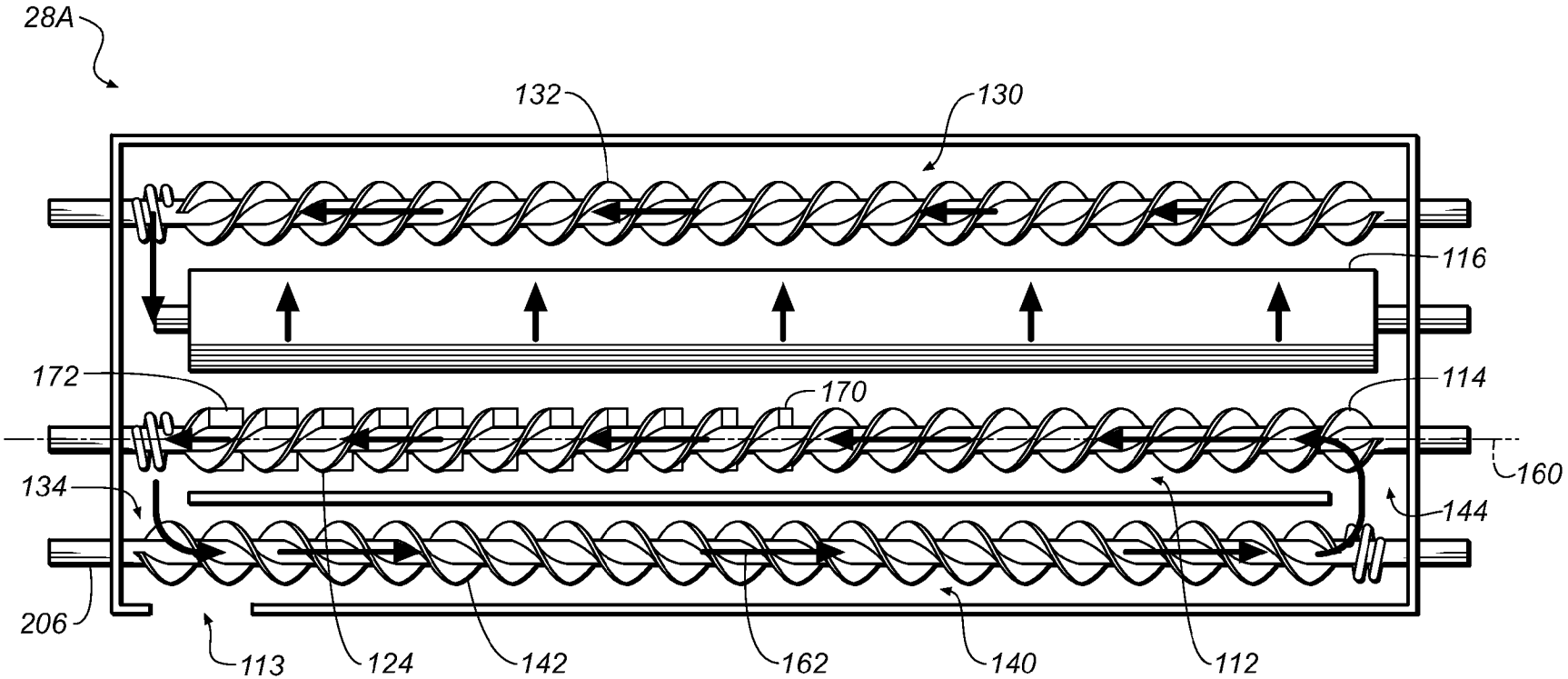
FIG. 3C is a longitudinal cross-sectional schematic view of one embodiment of the development station of FIG. 2 showing the directional flow of toner with an opening in a third location.

FIG. 3C shows the replenishment toner opening 113 arranged to supply additional toner proximate upstream end of the mixing auger 142, which in this embodiment is proximate to first end 206 of mixing auger 142. Here, the additional toner is added to the depleted developer and surplus developer so that all three would have the entire length of the mixing auger to be mixed and agitated.

It will be appreciated that each of these embodiments creates an opportunity for a full length of mixing provided by mixing auger 142 to be used to deliver developer that has a relatively homogeneous toner concentration and the toner charge level before the developer is transferred to the feed auger and onto the development roller. Opening 113 can alternatively be positioned to use less of the available length of a mixing auger 142 so long as the development station 28*a* provides developer at exposure window 117 having a desired range of toner concentration and toner charge levels.

Development Station with Force Splitting Transmission

A development station in an EP printer 20 typically uses at least one or more augers to mix, to move, and to charge developer and toner. For example, in the embodiment of FIGS. 2 and 3 development station 28A uses four augers to move and/or optionally mix developer 118 at various stages in a develop/replenish cycle. It will also be appreciated that each of these augers will at one time or another confront the developer drag related difficulties cited in the background section.

However, it will be understood that increasing the size, weight or cost of any one auger in the development station as a means of addressing developer drag related difficulties has a significant impact on the size, weight or cost of the EP printer 20 because any increase in the size, weight or cost of an auger will be replicated in all of the development stations in the EP printer, thus any increase will be multiplied by the number of development stations in the printer.

Conversely, to the extent that the size, weight or component cost of any auger in the development stations of an EP printer 20 can be reduced, the size, weight or component cost of the EP printer 20 will be reduced by a multiple of such reductions.

Figure 4:
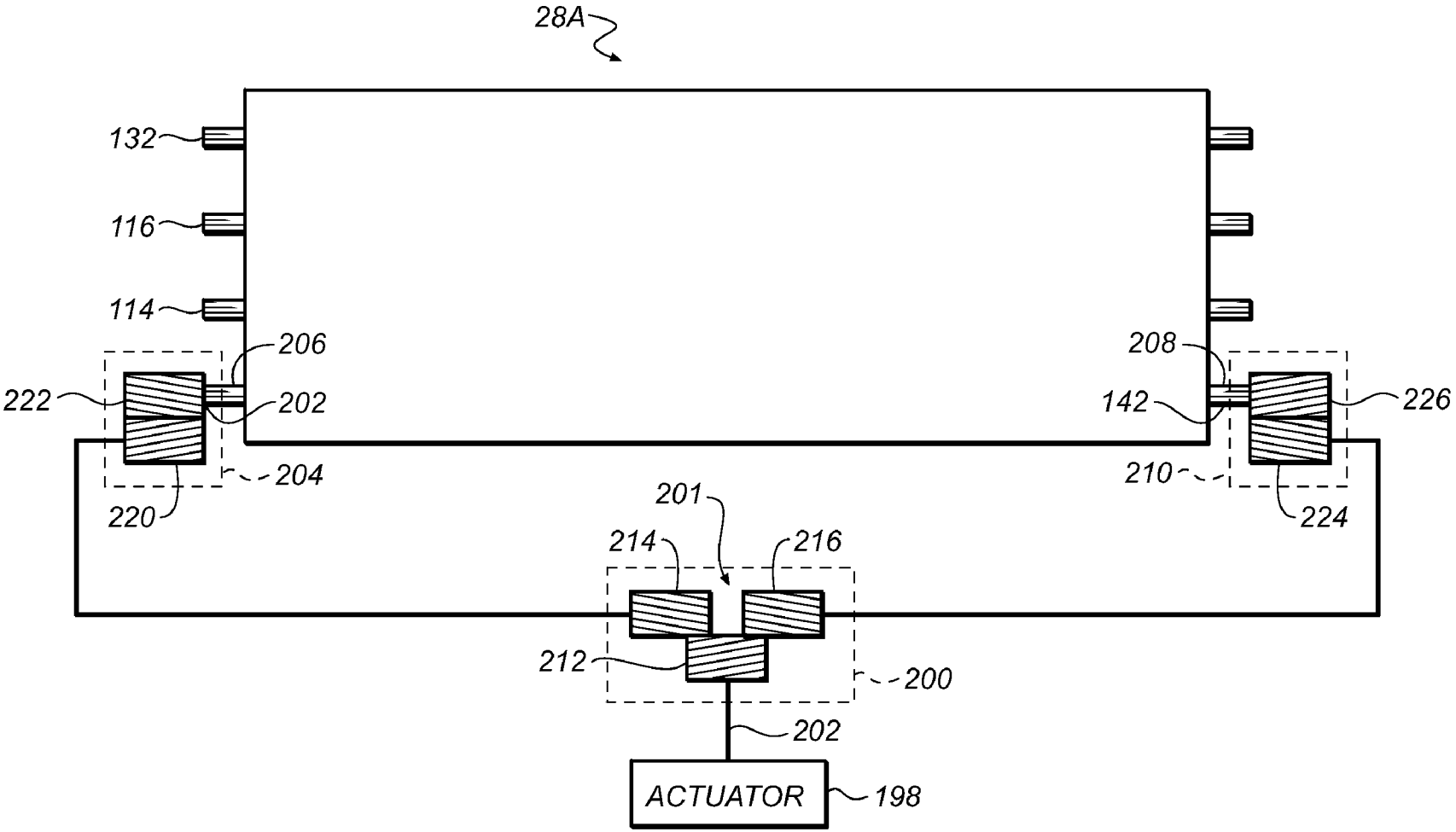
FIG. 4 shows a schematic view of an embodiment of the development station of FIGS. 2 and 3A.

With this in mind, FIG. 4 shows a schematic view of an embodiment of the development station 28A of FIGS. 2 and 3. As is shown in this embodiment, development station 28A has a drive transmission 200 with an input end 202, a first output 204 connected to drive rotation of a first end 206 of mixing auger 142 and a second output 210 connected to drive rotation of a second end 208 of mixing auger 142.

In the embodiment that is illustrated in FIG. 4, drive transmission 200 mechanically links input end 202 to first output 204 and to second output 210 and distributes an amount of force supplied at input end 202 to first output 204 and to second output 210 so that first output 204 and second output 210 respectively cause first end 206 of mixing auger 142 and second end 208 of mixing auger 142 to remain within a range of rotational positions relative to each other despite any variations in an amount of drag induced force experienced at first end 206 and at second end 208.

In this embodiment, drive transmission 200 is shown with a transmission linkage 201 linking input end 202 to first output 204 and second output 210 by way of an input gear 212, a first output gear 214 and a second output gear 216 that directly intermesh to drive first output 204 and second output 210 such that first output 204 and second output 210 are directly linked rotate according to the same input force. In this embodiment, first output gear 214 and second output gear 216 match so that first output 204 and second output 210 move at the same rate of rotation and in phase in response to movement of input end 202, for example, by an exterior actuator 198. In this way, the embodiment of drive transmission 200 illustrated in FIG. 4 can ensure that first end 206 and second end 208 are held in a range of rotational positions relative to each other. This arrangement of transmission 200 is not limiting and other conventional types of transmissions can be used to the extent that such other conventional transmissions perform the functions described herein.

As is also shown in the embodiment of FIG. 4, first output 204 and first end 206 are optionally mechanically linked by way of an intermeshing first drive gear 220 positioned at an end of first output 204 and first driven gear 222 positioned at first end 206 of mixing auger 142 and a second drive gear 224 positioned at an end of second output 210 and a second driven gear 226 that is positioned at second end 208 of mixing auger 142. In one embodiment, first drive gear 220 and first driven gear 222 are geared so that they intermesh in the same way that second driven gear 226 and second drive gear 228 intermesh so that the same amounts of input from first output 204 and second output 210 will cause the same amount of rotation of first end 206 and second end 208.

In certain embodiments, it may be necessary or useful to provide differential gearing of first output gear 212 and second output gear 214. This can be done as desired to the extent that any differences in output caused by such differences can be compensated for by way of other systems to ensure that the first end 206 and second end 208 of mixing auger 142 maintain a rotational position that is within the range of rotational positions. For example, it may be useful or necessary to compensate for differences in the gearing of first output gear 212 and second output gear 214 through differences in the way in which first drive gear 220 and first driven gear 222 and second drive gear 224 and second driven gear 226 intermesh. This allows for some flexibility in the design of the overall system as may be necessary to support other considerations in the design of the overall electrophotographic printer 20.

It will be appreciated that by driving mixing auger 142 from both first end 206 and second end 208 so that first end 206 and second end 208 of mixing auger 142 will remain within a fixed range of rotational positions relative to each other, the amount of torque experienced in mixing auger 142 at each of first end 206 and second end 208 will be significantly reduced as compared to a system where, for example, all of the torque created by the drag on mixing auger 142 is being applied through first end 206 of mixing auger 142. Because the amount of torque that must be applied through each end is reduced in this way mixing auger 142 can be made smaller, lighter, or of less costly materials.

The driving of input end 202 can be done in any conventional fashion. In the embodiment of FIG. 4, input end 202 is shown being driven by an actuator 198 which can be, for example and without limitation, a motor.

Figure 5:
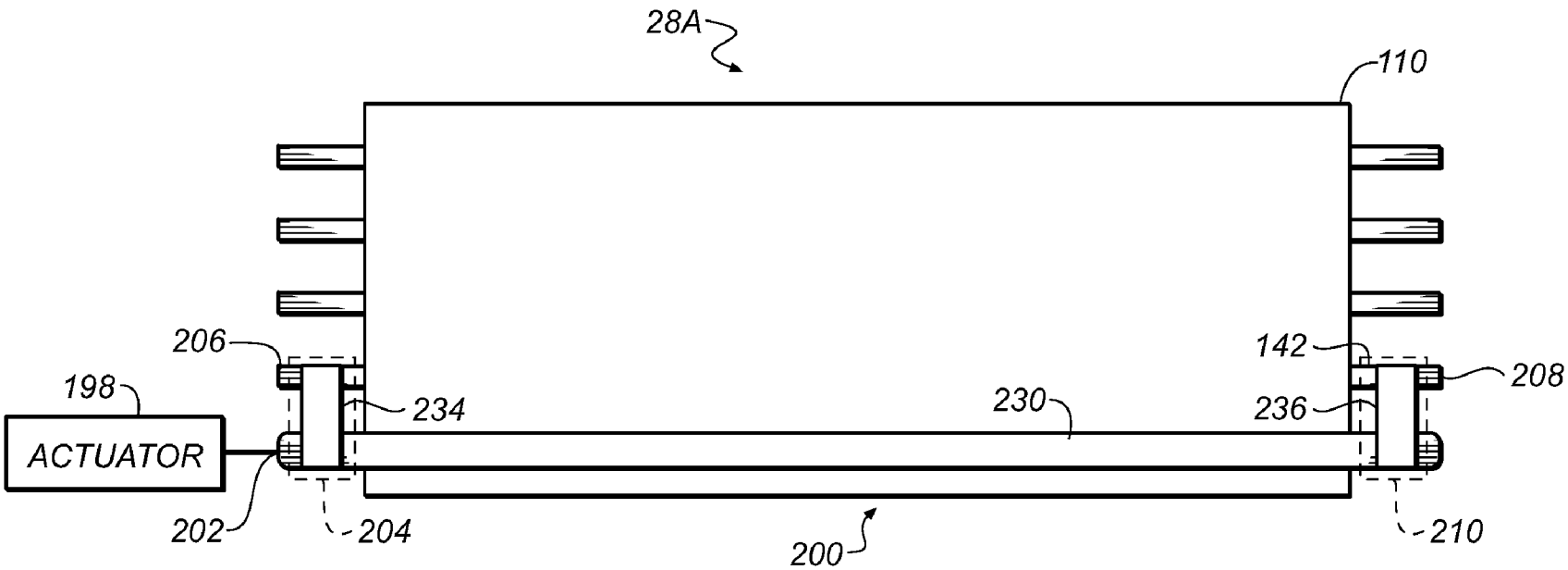
FIG. 5 shows an alternative embodiment of a development station.

FIG. 5 shows an alternative embodiment in which transmission 200 further comprises a cross-auger force conveyor 230 that extends from a side of housing 110 confronting first end 206 of mixing auger 142 to a side of housing 110 confronting second end 208 of mixing auger 142. Cross-auger force conveyor 230 is movable to convey a force from actuator 198 proximate to first end 206 of mixing auger 142 to second end 208. As is shown in the embodiment of FIG. 5, cross-auger force conveyor 230 comprises a shaft that is positioned outside of housing 110 and that can rotate in response to a rotational force provided at an input end 202 by actuator 198. In other embodiments, cross-auger force conveyor 230 can comprise, without limitation, any of a shaft, a rod, a belt, a chain, or a wire.

As is also shown in FIG. 5, in this embodiment, a first output 204 of transmission 200 is provided by a first flexible link 234 between cross-auger force conveyor 230 and first end 206 of mixing auger 142. In the embodiment illustrated in FIG. 5, first flexible link 234 comprises a belt, however, other forms of flexible interface including but not limited to wires, belts, chains, and flexible tension members can be used.

Similarly, in this embodiment, a second output 210 of transmission 200 is provided by a second flexible link 236 between cross-auger force conveyor 230 and second end 208 of mixing auger 142. In the embodiment illustrated in FIG. 5, first flexible link 234 comprises a belt, however, other forms of flexible interface including but not limited to wires, belts, chains, and flexible tension members can be used.

Figure 6:
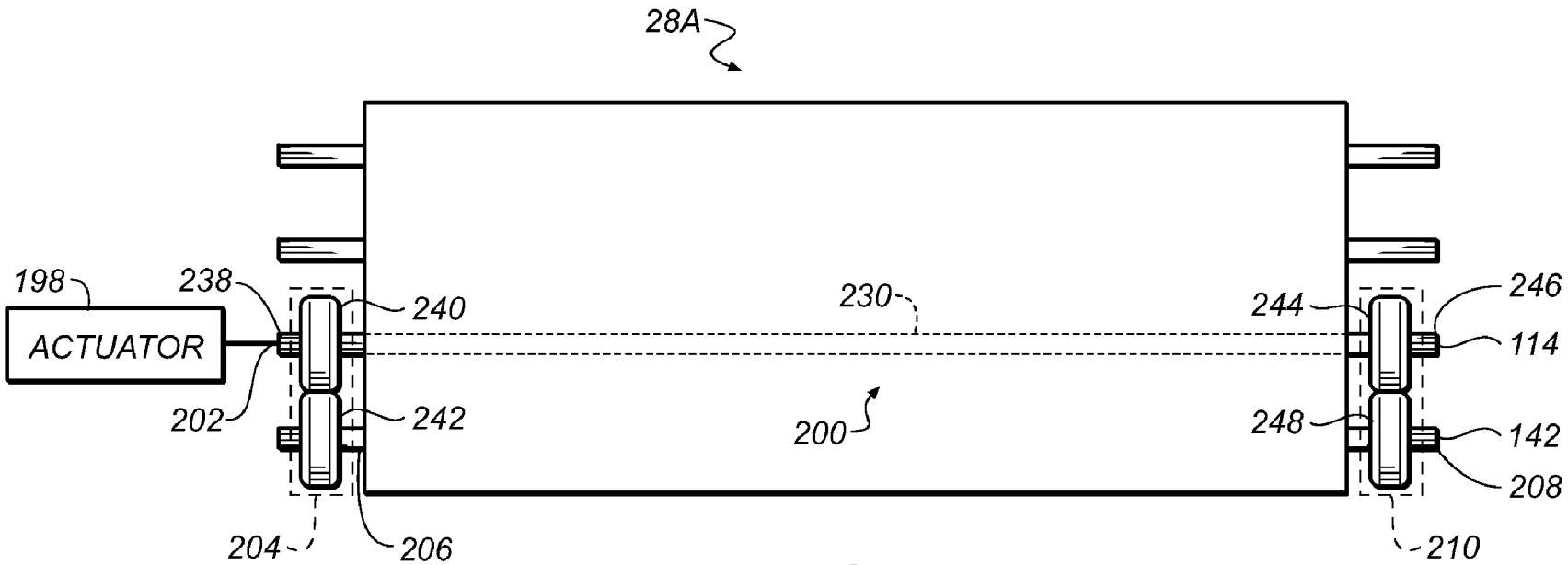
FIG. 6 shows an alternative embodiment of development station.

FIG. 6 shows an alternative embodiment where transmission 200 has a cross-auger force conveyor 230 that comprises another auger in development station 28A. Here, feed auger 114 is used as cross-auger force conveyor 230. However, any other auger available in development station 28A can also be used for this purpose. Preferably, the auger used for this purpose will be one that experiences a lighter conventional duty load than the driven auger. Alternatively, an auger used for this purpose may be one that is more capable of conveying such force without risk of damage. For example, an auger used for cross-auger force conveyance can optionally be one that has been made more robust for example by making the auger larger, or of denser materials. In this way, a robust auger can be used to enable another to be made less robust.

As is also shown in the embodiment of FIG. 6, transmission 200 uses feed auger 114 to act as a cross auger force conveyor 230. Here transmission 200 has an input end 202 provided by a first end 238 of feed auger 114 that is driven by actuator 198, a first output 204 that is provided by a frictional linkage between a first drive wheel 240 at first end 238 of feed auger 114 and a first driven wheel 242 positioned at first end 206 of mixing auger 142 and a second output 210 that is provided by a frictional linkage between a second drive wheel 244 at second end 246 of feed auger 114 and a second driven wheel 248 positioned at second end 208 of mixing auger 142.

Figure 7:
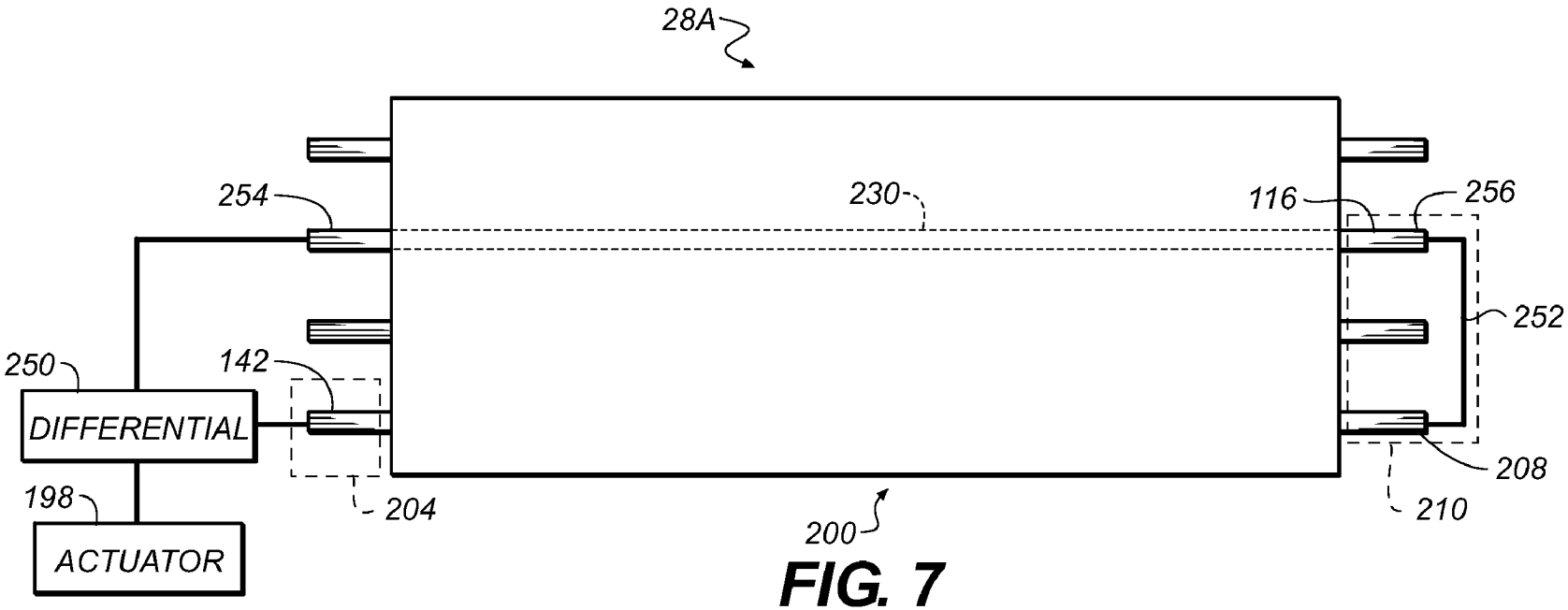
FIG. 7 shows and other alternative embodiment of the development station.

In still other embodiments of transmission 200, the cross-auger force conveyor 230 is a component of a toning shell, magnetic core, or development roller 116. In the embodiment of FIG. 7, development roller 116 is shown being used to provide a cross-auger force conveyor 230. In particular, as is shown in this embodiment, actuator 198 drives first output 204, which in turn directly drives a first end 254 of development roller 116. A friction linkage 252 such as a belt conveys force from a second end 256 of development roller 116 to second end 208 of mixing auger 142 to provide a second output 210 of transmission 200. As is also shown in FIG. 7 transmission 200 includes an optional limited slip differential 250 between first output 204 and second output 210. Limited slip differential 250 is of conventional design, receives force from actuator 198, and that adaptively distributes this force to a first end 206 of mixing auger 142 and to first end 254 of development roller 116

Here, limited slip differential 250 separately drives first end 206 of mixing auger 142 and first end 254 of development roller 116 and attempts to provide a constant torque to first end 206 of mixing auger 142. Because second output 210 is linked to mixing auger 142 in a frictional manner, there is a possibility of slippage. There is also torsional deformation of mixing auger 142. Where such slippage or deformation occurs, limited slip differential 250 drives mixing auger 142 despite angular displacement between first end 206 of development roller 116 and first end of mixing auger 142. In this embodiment, a frictional manner of linking first output 204 to first end 206 and/or second output 290 to second end 208 of mixing auger 142 can be provided that acts as a slip clutch, to allow slippage where necessary to help ensure constant rotational velocity. Frictional linkages such as frictioning wheels 240, 242, 244, and 246 can be used for this purpose, as can any known arrangement of belts of other forms of known slip clutch designs.

Figure 8:
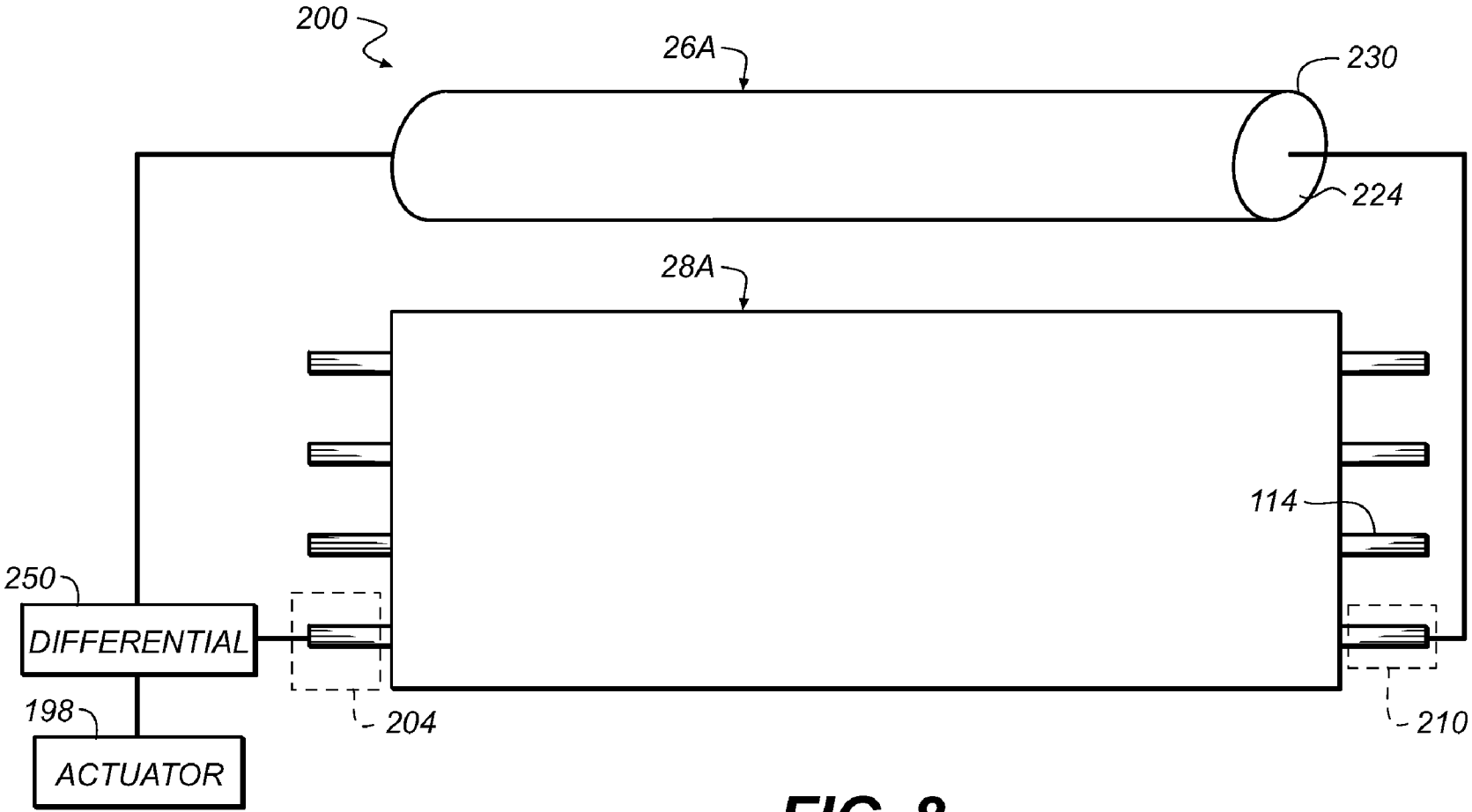
FIG. 8 shows still another alternative embodiment of a development station.

In still another embodiment illustrated in FIG. 8, cross-auger force conveyor 230 is a component of a photoconductor system, or primary imaging member 26A that is adjacent to and toned by development station 28A. One example of this is illustrated in FIG. 8, wherein primary imaging member 26A is shown being used for as a cross-auger force conveyor 230 linking an output end 10 of mixing auger 142 on one side of development station 28A to a transmission linkage 201 that is on an opposite side of development station 28A, while transmission linkage 201 also drives first output 204, shown here being located on the same side of development station 28A as transmission linkage 201.

It will be appreciated, that in any of the above described embodiments, force is applied to drive rotation of both ends of mixing auger 142. This force is linked to first end 206 and second end 208 of mixing auger 142. This can be done in the ways that are illustrated above, and, alternatively using any other form conventional gearing, belt linkages or any other form of positive mechanical linkage known to those of skill in the art to the extent that such linkages are consistent with what is described and claimed elsewhere herein.

As is noted generally above, another problem caused by the drag exerted by developer on an auger is that this drag can cause the auger to flex in a direction that is perpendicular to a direction of rotation and that flexes to an extent that is undesirable. This too can be addressed by increasing the size, weight, density or cost of an auger to provide sufficient beam strength in an auger to resist such flexing. However, here too, using such an approach to solve this problem imposes size, weight and cost burdens on EP printer 20 that are multiplied at least by the number of development stations in EP printer 20. In the embodiment of EP printer 20 shown in FIG. 1, this multiple is six. Accordingly, there is a need for an auger that can resist such flexing without imposing such burdens.

Figure 9:
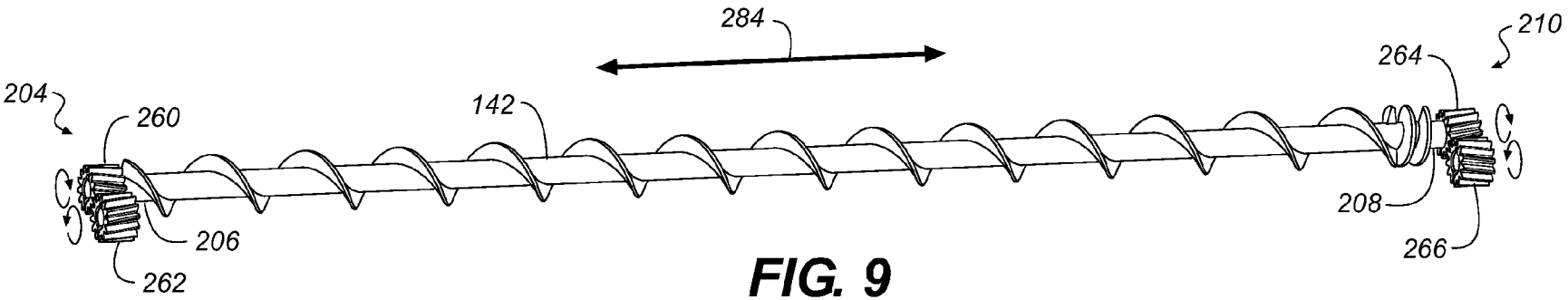
FIG. 9 shows an embodiment development station cooperating with an auger to reduce auger flexing.

FIGS. 9, 10, 11, 12, and 13 show another embodiment of a mixing auger 142 having optional features that allow mixing auger 142 to resist such flexing without requiring that the mixing auger be made more rigid. As is illustrated in FIG. 9 in this embodiment, a mixing auger 142 has a first driven gear 260 provided at first end 206 of mixing auger 142 that is driven by a first driving gear 262 provided by first output 204 of transmission 200. Mixing auger 142 further has a second driven gear 264 provided at second end 208 of mixing auger 142 that is driven by a second output gear 266 provided by a second output 210 of transmission 200.

Figure 11:
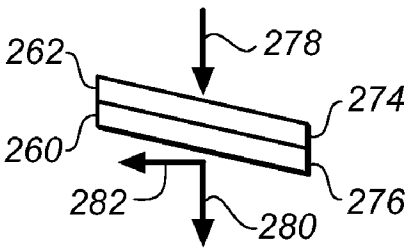
FIG. 11 shows the forces created by gear interactions at a first end of the auger of FIG. 9.
Figure 10:
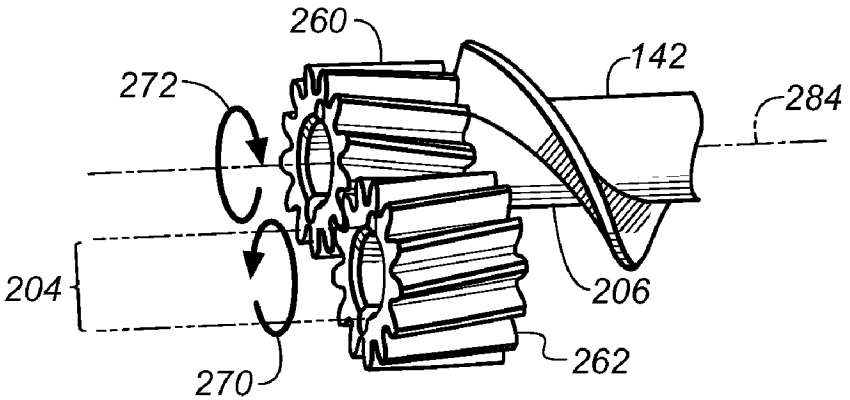
FIG. 10 shows gearing interactions at a first end of the auger of FIG. 9.

FIG. 10 shows an enlargement of the gearing interactions between first driven gear 260 and first driving gear 262. As is illustrated in FIG. 10 first output 204 shown in phantom in FIG. 10, drives first driving gear 262 to rotate in a counter clockwise direction 270, which in turn drives first driven gear 260 to rotate in a clockwise direction 272. As is illustrated in FIG. 11, first driving gear 262 has driving gear teeth 274 in a left-handed arrangement that is angled as shown in FIG. 11 to mesh with a driven gear teeth 276 in a right-handed arrangement that are angled as shown in FIG. 11. When driving gear teeth 274 apply a rotational force 278 on driven gear teeth 276 two forces are generated, a rotational force 280 that rotates mixing auger 142 and a first thrust force 282 that thrusts first end 206 of mixing auger 142 away from second end 208 of mixing auger 142 along a thrust axis 284.

Figure 13:
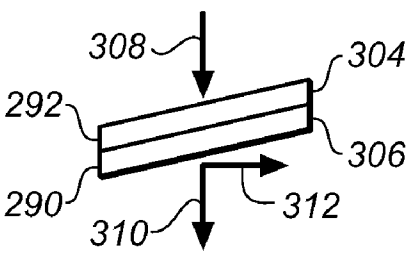
FIG. 13 shows the forces created by gear interactions at the end of the auger of FIG. 9.
Figure 12:
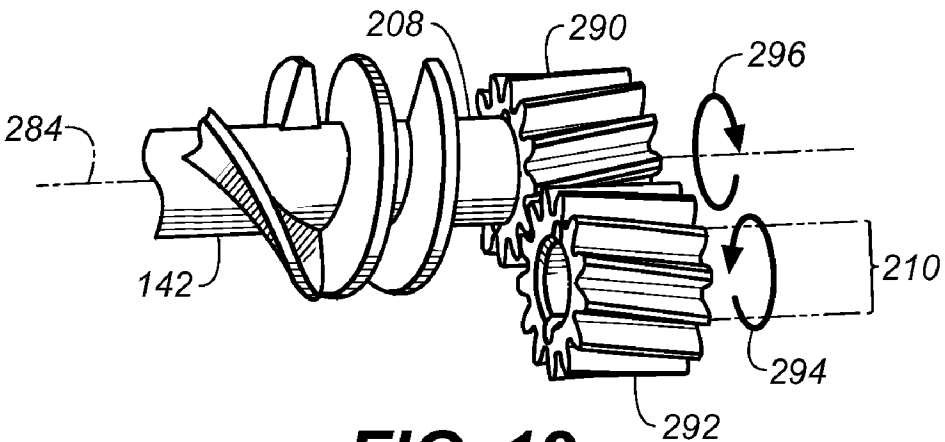
FIG. 12 shows gearing interactions at a second end of the auger of FIG. 9.

At second end 208 of mixing auger 142, an inverse arrangement is provided. Specifically, FIG. 12 shows an enlargement of the gearing interactions between a second driven gear 290 and a second driving gear 292. As is illustrated in FIG. 12 second output 210 shown in phantom in FIG. 12, drives second driving gear 292 to rotate in a counter clockwise direction 294, which in turn drives second driven gear 290 to rotate in a clockwise direction 296. As is illustrated in FIG. 13, driving gear 292 has driving gear teeth 304 in a right handed arrangement that is angled as shown in FIG. 13 to mesh with a driven gear teeth 306 in a left-handed arrangement that are angled as shown in FIG. 13. When second driving gear teeth 304 apply a rotational force 308 on second driven gear teeth 306 two forces are generated, a rotational force 310 that rotates mixing auger 142 and a second thrust force 312 that thrusts second end 208 of mixing auger 142 away from first end 206 of mixing auger 142 along thrust axis 284 of mixing auger 142.

First thrust force 282 and second thrust force 312 are therefore in opposition. This induces a tension in mixing auger 142. The tension in mixing auger 142 acts to prevent mixing auger 142 from flexing without requiring that mixing auger 142 have sufficient beam or bending strength to prevent such flexing. Further, it will be appreciated that this tension can be used to counteract thrust force applied to the auger by the developer load that tend to thrust an auger such as a mixing auger 142 against housing 110 and by eliminating friction against thrust bearings that are conventionally used to manage such thrust.

Optionally, any of gears 260, 262, 264 and 266 can include helical gears to provide the desired axial forces necessary to create the above described tension. Such helical gears advantageously can be arranged such that as an amount of force applied to mixing auger 142 to overcome drag increases, the amount of first thrust force 282 or second thrust force 312 increases such that the amount of tension in mixing auger 142 increases. In this way, when drag is higher, the amount of tension in mixing auger 142 urging mixing auger 142 into axial alignment increases.

The application of axial tension to mixing auger 142 allows mixing auger 142 to be made with a smaller outer diameter and to be driven with less torque in total than is necessary with other designs, further reducing the torque that the mixing auger 142 must be capable of managing. Additionally, it will be appreciated by eliminating the need to use the size or strength of an auger such as; for example, mixing auger 142 itself to resist flexing the mixing auger 142 can be made smaller further reducing the surface area of mixing auger 142 against which drag can be applied by the developer against mixing auger 142. This further reduces the amount of torque that mixing auger 142 will confront.

The application of axial tension on mixing auger 142 can significantly reduce chatter by helping to prevent axial displacement of mixing auger 142 during rotation. The application of axial tension can further enable mixing auger 142 to be made smaller or less strong than prior art augers again because there is no need to provide sufficient axial strength to prevent non-axial rotation of the feed auger. Instead the tension available in the system protects against this.

Figure 14A:
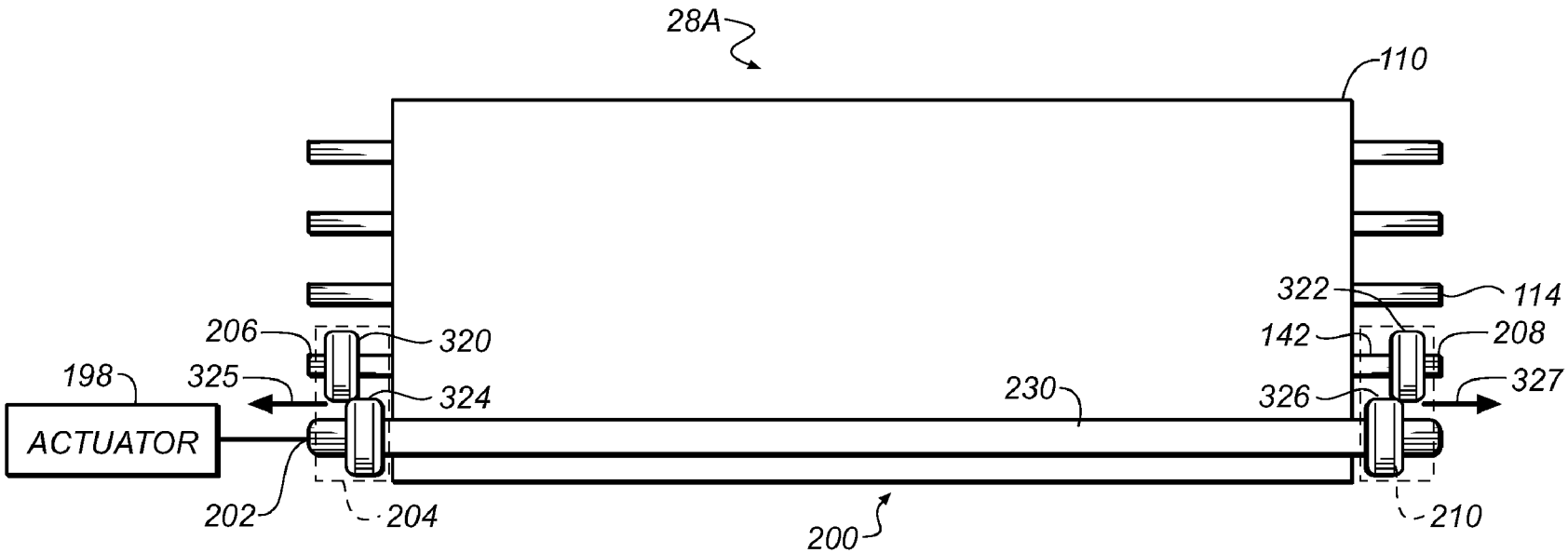
FIGS. 14A and 14B show alternative embodiments of development stations cooperating with an auger to reduce auger flexing.

As is illustrated generally in FIG. 14A, it is not necessary to use an arrangement of gears to tension mixing auger 142. In particular, as is shown in this embodiment wheel 320 and wheel 322 are provided respectively at first end 206 and second end 208 of mixing auger 142. Here, transmission 200 provides a first output 204 with a first driving wheel 324 positioned proximate to first end 206 to apply a first urging force 325 that drives wheel 320 away from second end 208 of mixing auger 142. As is further shown in this embodiment, transmission 200 further provides a second output 210 with a second driving wheel 326 positioned proximate to second end 208 to apply a second urging force 327 that drives drive wheel 322 away from first end 206. In this embodiment wheels 320 and 324 and 322 and 326 are positioned in an axially interfering arrangement in that wheels 320 and 322 are arranged with an axial separation that is less than an axial separation provided by wheels 324 and 326. At least one of wheels 320 and 324 and wheels 322 and 336 is at least in part resiliently flexible. This provides a tension in mixing auger 142.

Figure 14B:
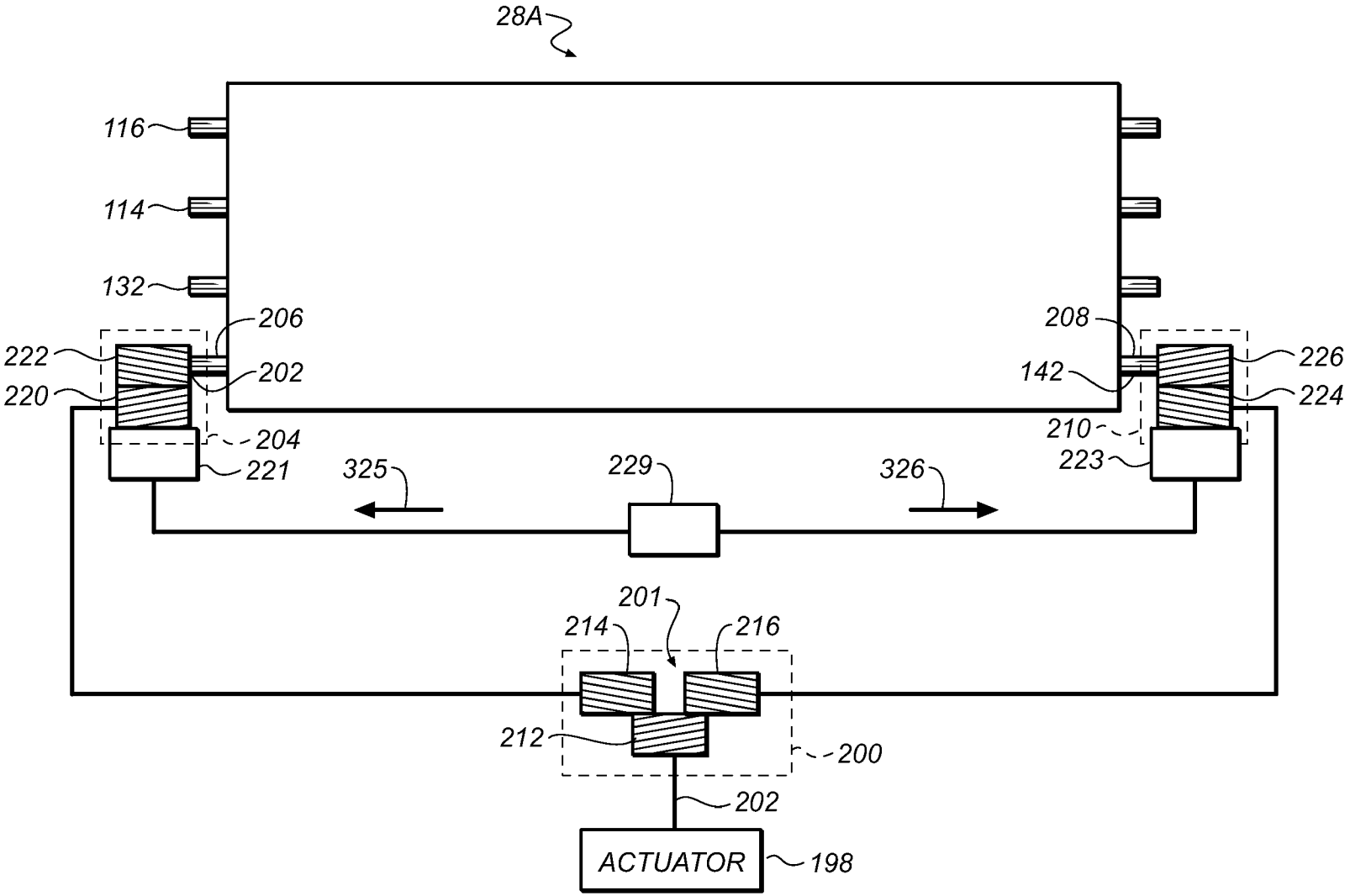

Similarly, as shown in FIG. 14B, tension can be created in an auger, such as auger 142, by providing a first mounting 221 for first output 204 and a second mounting 223 for second output 210 that are separated by a separator 229. Separator 229 applies a separating force that drives first mounting 221 apart from second mounting 224. This induces first urging force 325 at first output 204 that drives first end 204 of mixing auger 142 away from second end 208 of mixing auger 142 and second urging force 327 at second end 208 that drives second end 208 away from first end 206. In certain embodiments, separator 229 can comprise a spring of any known type, any resilient material or member, or any known mechanical, electro-mechanical, magnetic or electromagnetic mechanism or arrangement that provides a force urging separation between first mounting 221 and second mounting 223. As is illustrated generally in FIG. 16, it is not necessary to use only an arrangement of gears or wheels to provide tensioning thrust on mixing auger 142. Here, transmission 200 provides a first output 204 with a first driving belt 321 positioned proximate to first end 206 but linked thereto in a manner that at least in part pulls first end 206 away from second end 208, while transmission 200 provides a second output 210 with a second driving belt 323 positioned proximate to second end 208 but linked thereto in a manner that at least in part pulls second end 208 away from first end 206, this provides a tension in mixing auger 142.

It will be understood that in addition to the above described advantages of applying a tension to mixing auger 142, such tension can be used to further achieve a variety of additional advantageous effects. For example, such tension tends to draw out any inherent or static curvature in mixing auger 142 created during fabrication or use of mixing auger 142.

The application of tension can also reduce the extent of any inherent axial curvature in mixing auger 142 and can resiliently bias mixing auger 142 toward an axial rotation state against any drag that urges mixing auger 142 into an eccentric rotation. This reduces the extent to which pinch points can be created and to which mixing auger 142 can be brought into contact with, for example, housing 110.

While the various embodiments of FIGS. 2-15 have been described with respect to mixing auger 142, they are applicable to any other auger in any development station and can be modified as necessary to fit the loading circumstances of any particular auger. For example, reference is made to FIG. 3 in which a discussion has been presented regarding the flow of developer in a development station 28 and in which it has been shown that for feed auger 114, the intensity of the loading is continuously higher at a first end 330 of feed auger 114 where developer is supplied to feed auger 114 than it is at a second end 332. This is because feed auger 114 supplies toner to development roller 116 at a generally constant volume of developer per unit length of development roller 116, thus, as a flow of developer is advanced across feed auger 114 the magnitude of the flow is drawn down by the transfer of developer onto development roller 116.

Figure 16:
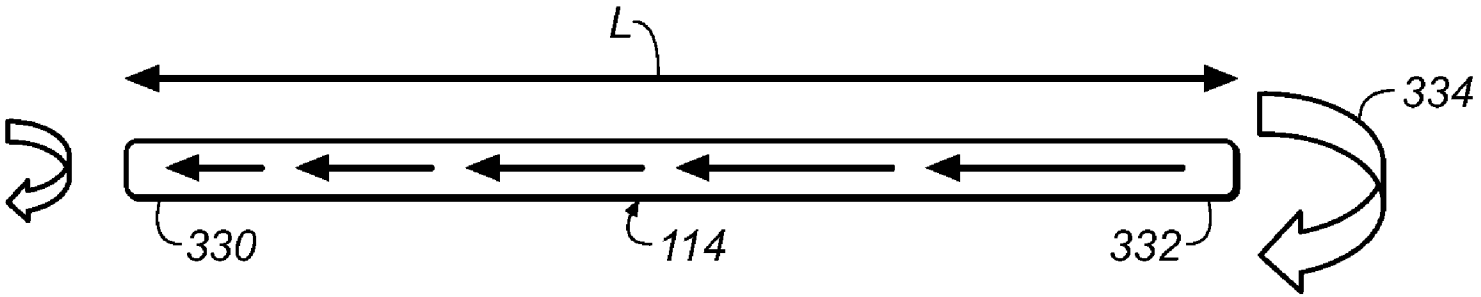
FIG. 16 shows an example of forces experienced at ends of an auger with a particular toner load.

Accordingly, as shown in FIG. 16, the portion of the total developer induced drag 334 experienced at second end 332 is greater than the portion of the total developer induced drag experienced at first end 330 applied by the greater amounts or flow of developer 118 at second end 332 of feed auger 114 that is proximate to the source of supply of developer (not shown) than at a first end 330 end of feed auger 114. This creates a steady state imbalance of drag forces at feed auger 114. To drive such feed auger 114, any embodiment of transmission 200 described herein can be arranged, adjusted, or operated such that transmission 200 applies a steady state first amount of force at a first end that is greater than a steady state second amount of force at second end.

Figure 17:
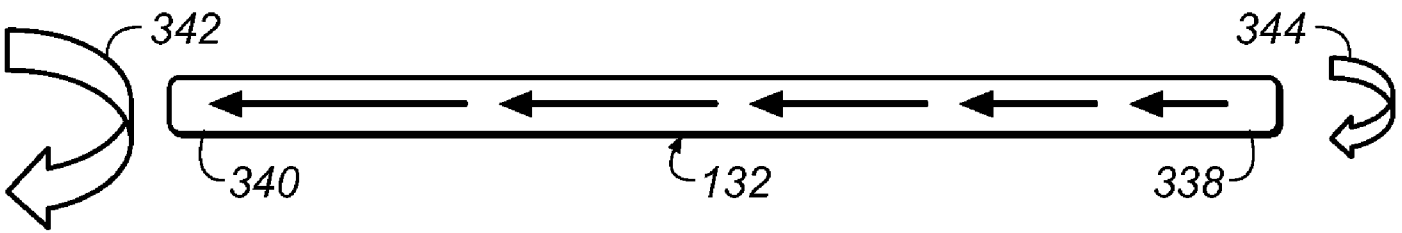
FIG. 17 shows an example of forces experienced at ends of an auger with a particular toner load.

Conversely, as shown in FIG. 17 a return auger 132 receives a relatively consistent amount of toner per unit length of return auger 132 and is rotated to move to create a flow of developer toward an output end 340 of return auger 132. As is shown in FIG. 17, return auger 132 is rotated to create a flow from second end 338 of return auger 132 toward first end 340 of return auger 132. Here the amount of toner flow along return auger 132 increases on a per unit length of return auger 132 from second end 338 of return auger 132 and reaches a high point generally at a first end 340 of return auger 132. Accordingly, as shown in FIG. 17, the portion of the total developer induced drag 342 experienced at first end 340 is greater than the portion 344 of the total developer induced drag experienced at second end 338 applied by the greater amounts or flow of developer at second end 332 of feed auger 114 that is proximate to the source of supply of developer (not shown) than at a first end 330 end of feed auger 114. Here too, it will be appreciated that as required the various embodiments of transmission 200 described herein can be arranged or operated such that transmission 200 provides more force at first end 340 of return auger 132.

Development Station with Independent Actuators

FIG. 18 shows yet another embodiment of a development station 28A. In this embodiment development station 28A has the same general arrangement illustrated in FIGS. 2, 3 and 4. However, in this embodiment an electronic control system 360 is used. Electronic control system 360 has a first actuator 362 driving first end 206 of mixing auger 142 at first output 204 and a second actuator 364 driving second end 208 of mixing auger 142 at second output 210. First actuator 362 and second actuator 364 typically comprise motors that can be rotated in response to electrical signals provided thereto. In this regard first actuator 362 and second actuator 364 can comprise stepper motors or conventional direct current or alternating current motors of known design. In other embodiments first actuator 362 and second actuator 364 can comprise any other form of electrically controlled actuators that can receive an electrical signal and generate, in response to the received electrical signal, a determined force within a range of available forces that can be applied to first end 206 and second end 208 respectively to cause mixing auger 142 to rotate. Similarly, first output 204 and can comprise any known form of linkage between first actuator 362 and mixing auger 142 including but not limited to the types of first output 204 shown in the embodiments above while second output 210 can comprise any known form of linkage between first actuator 362 and mixing auger 142 including but not limited to the embodiments of second output 210 described above.

Figure 18A:
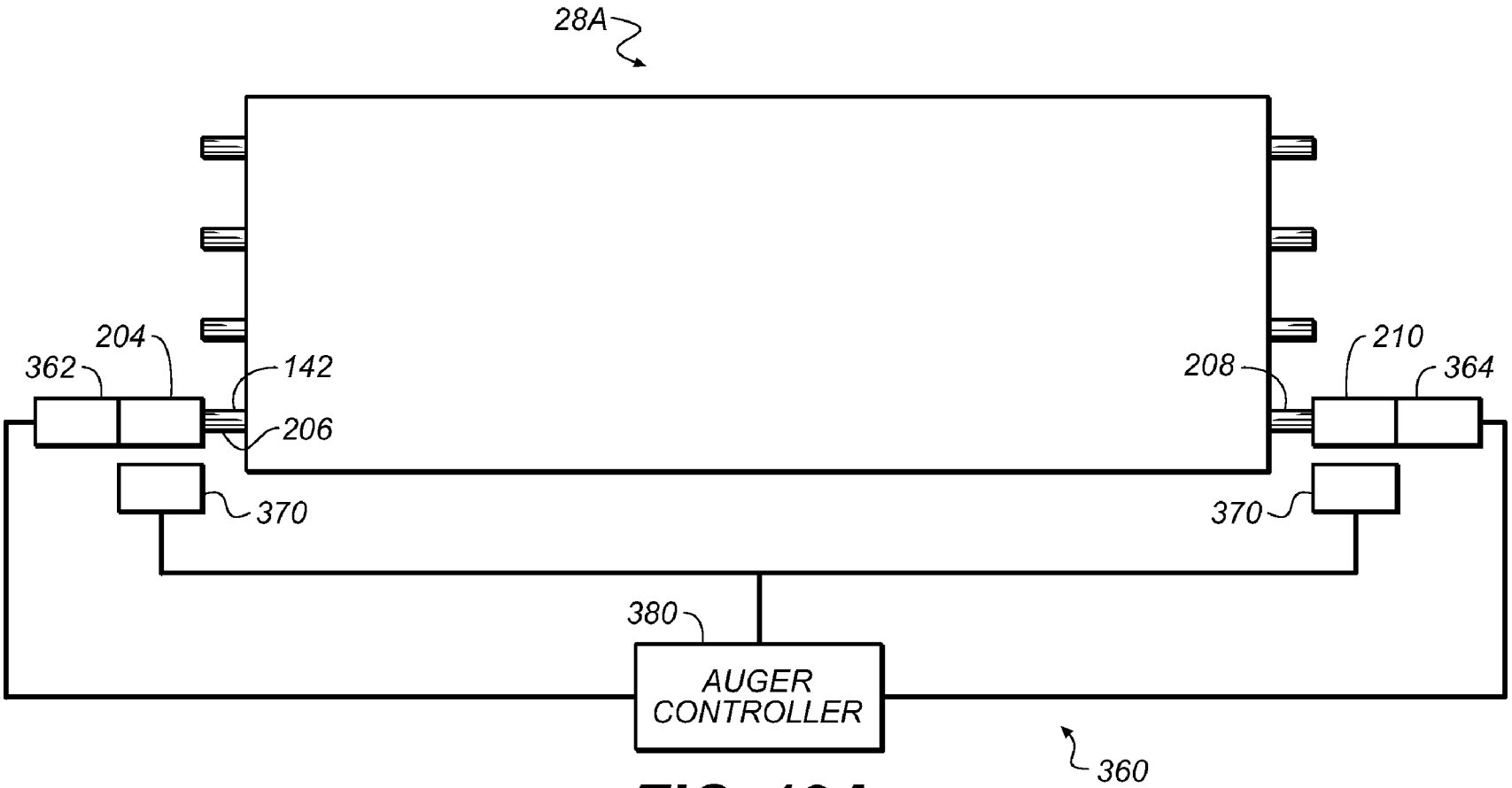
FIGS. 18A and 18B show additional embodiments of development stations.

In the embodiment of FIG. 18A, a first sensor 370 senses a condition from which a rotational position of first end 206 of mixing auger 142 can be determined and generates a first sensor signal from which the rotational position of the first end 206 of mixing auger 142 can be determined. Similarly, a second sensor 372 senses a condition from which a rotational position of a second end 208 of mixing auger 142 can be determined and generates a first sensor signal from which the rotational position of the second end of the auger can be determined.

First sensor 370 and second sensor 372 can comprise any type of mechanical, electro-mechanical, optical, electrical or magnetic sensor of any type that can sense any condition that is indicative of a rotational position of first end 206 and second end 208 of mixing auger 142 and that can provide a first sensor signal and a second sensor signal from which auger controller 380 can determine the rotational position of first end 206 and second end 208.

Figure 18B:
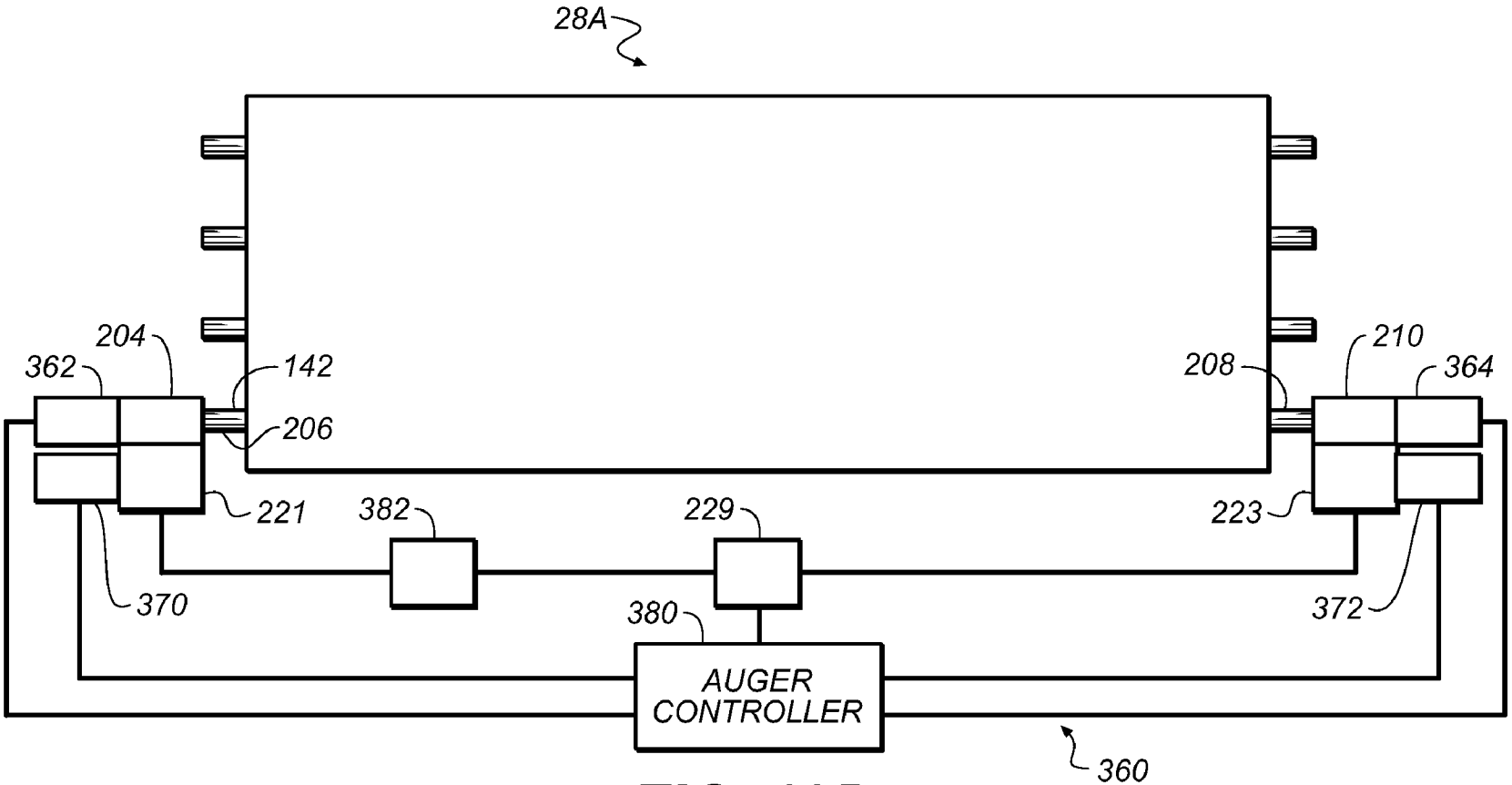

Also shown in the embodiment of FIGS. 18A and 18B, is an auger controller 380 that receives the first sensor signal and the second sensor signal and generates a first control signal causing the first actuator to operate so that a first force is applied to the first end of the auger and generates a second control signal causing the second actuator to operate so that a second force is applied to the second end of the auger. The first force and second force work together to rotate the auger against a drag created by the developer being moved. Auger controller 380 can comprise any form of control circuit or system that can receive the first sensor signal from first sensor 370 and the second sensor 372 and can determine the relative angular position of first end 206 and second end 208 of mixing auger 142, based upon this determination, can determine a first control signal to send to first actuator 362 and a second control signal to send to second actuator 364 that cause rotation and/or tensioning of auger on auger as described and claimed herein. In this regard auger controller 380 can comprise any known type of logic or control circuit including but not limited to a processor, controller, microcontroller, or hardwired control logic circuit.

It will be appreciated that in general, during steady state operation of a developments station 28A-28F, it will be desirable for auger controller 380 to generate signals that are calculated to cause first actuator 342 and second actuator 344 to apply equal amounts of force to each of first end and second end. However, this may not always be a desirable operational model. For example, as is shown and discussed with reference to FIGS. 16 and 17, in certain circumstances the steady state operation of an auger such as a feed auger 114 or return auger 132 may indicate that it is appropriate to apply different levels of force at different ends of such an auger in steady state operation.

Further, it may be useful for auger controller 380 to have a steady state of rotational operation wherein the first control signal and second control signal cause the first end of the auger and the second end of the auger to remain within a range of rotational positions relative to each other with the range being defined so that differences in the rotational positions of the first end and the second end create a determined range of shear stress in the auger. Such rotation induced shear stress can be used for example to create or enhance a tension in the auger being rotated in this manner.

Typically, this desired positional relationship is one where any differences between the rotational position of first end 206 and the rotational position of the second end 208 are maintained at a target level. In certain embodiments, the target can be a zero difference level. However, in other embodiments, the target can include an offset level.

There are a variety of ways in which the desired positional relationship can be maintained once established. For example, the first force and the second force can be applied to cause the first end and the second end to maintain a determined average rotational positional relationship over the course of each rotation of the auger. In another example, the first force and the second force can be applied to cause the first end and the second end to maintain the desired positional relationship by maintaining a determined average rate of rotational velocity at the ends of the auger over the course of each rotation of the auger. These averages have been described in terms of frequency of rotation, however, it will be appreciated that these averages can be equivalently calculated or described in terms of units of time, phase or other similar expressions.

However, it can be appreciated that for certain applications or in certain situations it can be appropriate to operate in a mode where a difference between the rotational position of the first end and the rotational position of the second end is allowed either on a temporary basis or as a planned mode of operation. It will further be appreciated that in certain embodiments the extent to which such a variation is tolerated can be a function of the elasticity of the material from which mixing auger 142 is fabricated. That is for more elastic materials a greater range of variation can be tolerated when the auger is fabricated using more elastic materials, while a lesser range of variation can be tolerated when the auger is fabricated using less elastic materials. An advantage of allowing a greater range of variation for a mixing auger 142 that is more elastic is that fewer control adjustments may be required. For example, the first force and the second force can be applied to cause a difference to occur in the rotational positions of the first end and the second end that create a first portion of the shear stress in mixing auger 142 while the drag induces a second portion of the shear stress in mixing auger 142. Where this is done, auger controller 380 can cause first actuator and second actuator to provide the first force and the second force so that the first portion is less than half of the total shear stress induced in the auger during rotation.

The amount of tension created in an auger, for example, mixing auger 142 driven in accordance with this embodiment, can be defined as a function of both the extent to which the rotational positions of the first end 206 and the second end 208 align, with more tension being created in mixing auger 142 when there is less alignment, and as a function of the extent to which forces are applied that urge first end 206 away from second end 208 while also urging second end 208 away from first end 206. In the embodiment of FIG. 18A, the extent of the rotational positions can be adjusted to provide tension in mixing auger 142.

Figure 15:
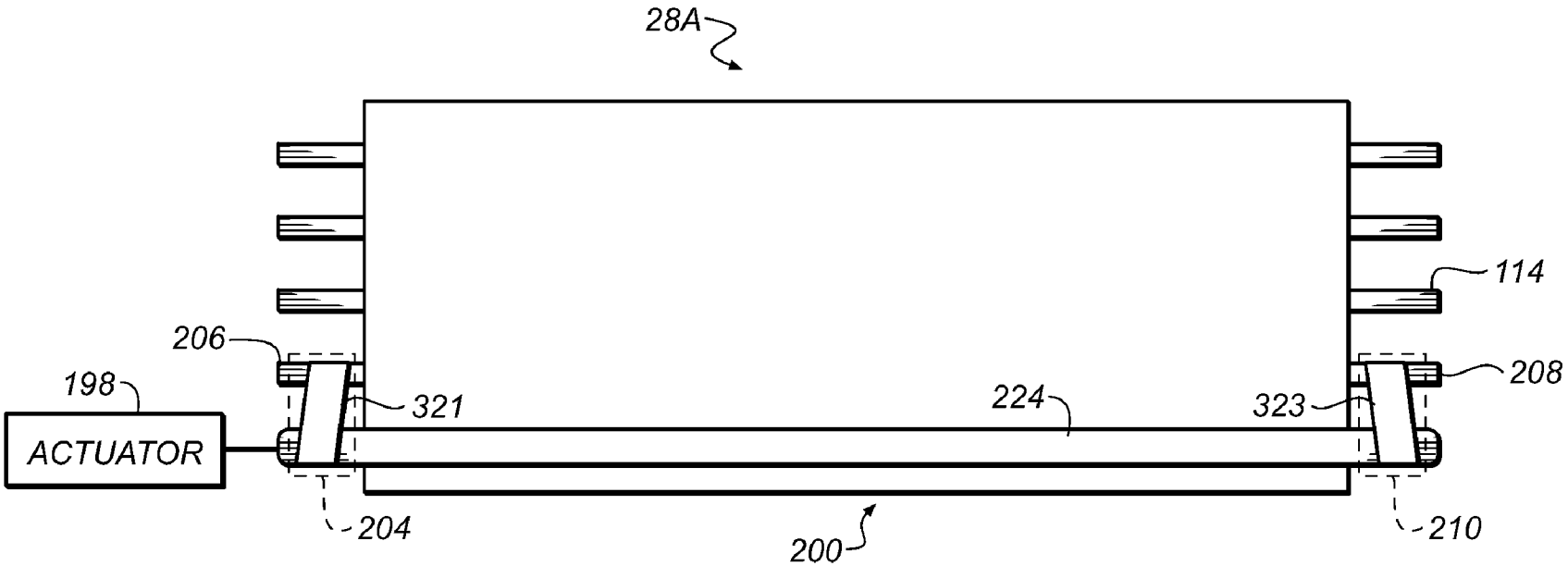
FIG. 15 shows an alternative embodiment of a development station cooperating with an auger to reduce auger flexing.

Other techniques such as those shown and described in FIGS. 15 and 16 can also be used to induce tension in mixing auger 142. In particular, as is discussed generally above and as is shown in greater detail in FIG. 18B, tension can be created in mixing auger 142 by providing a first mounting 221 for first output 204 and a second mounting 223 for second output 210 that are separated by separator 229. Separator 229 applies a separating force that drives first mounting 221 apart from second mounting 224. In such an embodiment separator 229 can comprise an actuator which can include any of a solenoid, motor, or other known mechanism or article that is capable of converting an electrical signal into a mechanical output, and that is arranged to drive first mounting 221 and second mounting 223 in a manner that will induce a first urging force 325 at first output 204 that drives first end 204 of mixing auger 142 away from second end 208 of mixing auger 142 and a second urging force 327 at second end 208 that drives second end 208 away from first end 206. One or more conventional sensors 382 can optionally be provided to sense the amount of tension applied to mixing auger 142, an amount of strain exhibited by mixing auger, an extent of a separation between first mounting 223 and second mounting 225 or any other condition that can be used by auger controller 380 to determine a range of tension in mixing auger 142.

The amount of tension created in mixing auger 142 driven in accordance with the embodiment of FIG. 18B, can be defined as a function of both the extent to which the rotational positions of the first end 206 and the second end 208 align, with more tension being created in mixing auger when there is less alignment, and as a function of the extent to which forces are applied that urge first end 206 away from second end 208 while also urging second end 208 away from first end 206.

In the embodiments illustrated in FIGS. 4-17 printer controller 82 cause actuator 198 to limit the limit input force so that the first force and the second force are applied so that the first portion is less than half of the total shear stress induced in the auger during rotation. It will also be appreciated that the embodiments of FIGS. 4-15 transmission 200 can act in a similar manner to controller with respect to providing a desired angular relationship. It further will be appreciated that first actuator 362 and second actuator 364 can be joined to any auger in any of the manners described above in FIGS. 9-15 to induce a tension or to achieve other effects described in these embodiments.

While the various embodiments of FIGS. 18A and 18B have been described with respect to mixing auger 142, they are applicable to any other auger in any development station and can be modified as necessary to fit the loading circumstances of any particular auger.

Methods for Operating a Development Station

Figure 19:
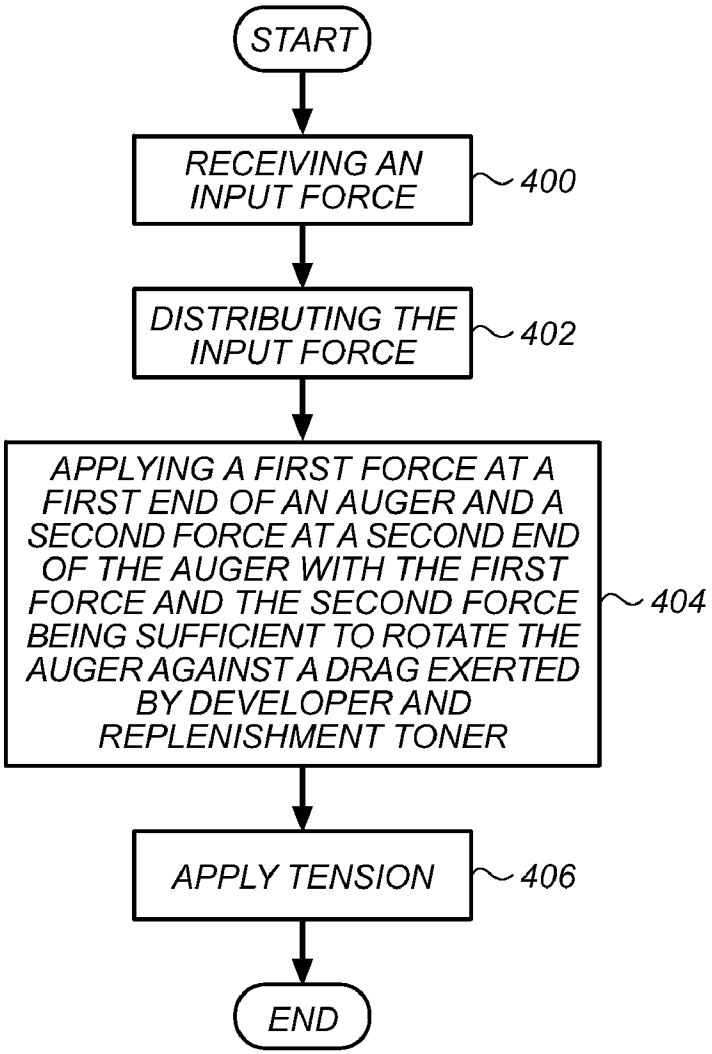
FIG. 19 shows one example embodiment of a method for driving an auger in a developer station.

FIG. 19 shows a first embodiment of a method for operating a development station. It will be appreciated that this method can be implemented automatically by way of electronic or mechanical logic and control systems such as those that are described above.

As is shown in FIG. 19, in the first embodiment, an input force is received (step 400) and the input force is then distributed (step 402) and applied to the first end and to the second end of the auger (step 404) and so that a first force can be applied to a first end of the auger and a second force can be applied to a second end of the auger. In this embodiment, the first force and the second force are sufficient to rotate the auger against a drag exerted by the developer and the replenishment toner. Further, as is discussed above, both the first force and the second force are less than a third force applied a single driven end of an alternative auger to rotate the alternative auger against the drag. Further, the auger has a first yield strength at the first end and a second yield strength at the second end that are less than a third yield strength required to receive the third force at the driven end of the alternative auger.

An optional step of tensioning the auger can also be performed (step 406). This tensioning in the auger can be created, generally as described above and can be fixed or can vary with an amount of drag acting on the auger as is also described generally above.

Figure 20:
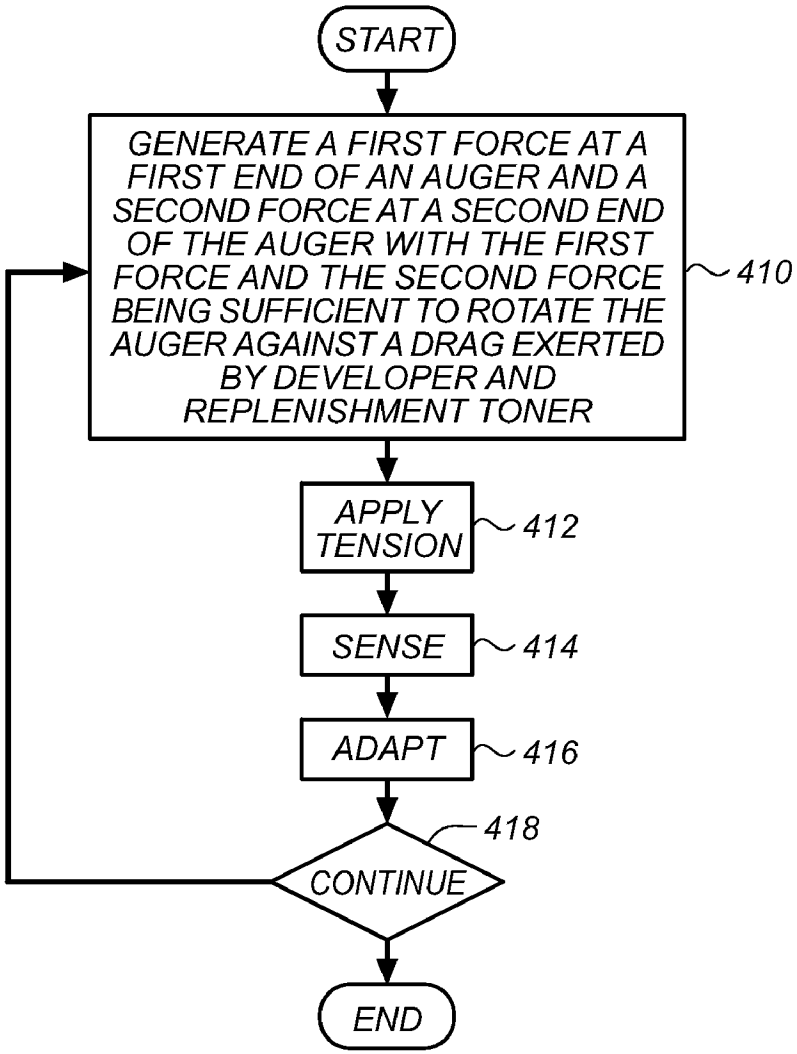
FIG. 20 shows another example embodiment of a method for driving an auger in a developer station.

As is shown in FIG. 20, in a second embodiment, of a method for driving an auger, the force first force is applied a first end of the auger using a first actuator and a second force is applied to a second end of the auger using a second actuator (step 410). In this embodiment, the first force and the second force are sufficient to rotate the auger against a drag exerted by the developer and the replenishment toner. Further, as is discussed above, both the first force and the second force are less than a third force that would be applied at a single driven end of an alternative auger to rotate the alternative auger against the drag. Further, the auger has a first yield strength at the first end and a second yield strength at the second end that are less than a third yield strength required to receive the third force at the driven end of the alternative auger. The amount of the first force and the second force can be determined by signals generated by printer controller 82.

The application of the first force and the second force can optionally be accompanied, as is shown in FIG. 20, by the application of a tension along the auger (step 412). As is discussed above, tension can be created in an auger by applying forces that drive a first end of the tensioned auger away from a second end of the auger and that drive a second end of the auger away from a first end of the auger or by applying forces that drive the first end of the auger to have a different rotational position than the first end. In operation, it can be useful to adjust the tension in the auger so as to enhance the performance of the auger. For example, when development station has been idle for a period of time, developer in the development station tends to settle. Such settling increases the amount of drag created by the developer. Accordingly, it can be beneficial to perform the tensioning step by receiving an activation signal to activate the development station, determining that the development station has not been operated for at least a minimum amount of time prior to receipt of the activation signal and, in response to such determining, increasing tension in the auger before initiating rotation of the auger. Similarly, other factors can create density increases in the developer in a development station, such as the introduction of additional toner. Accordingly, the step of tensioning can optionally include sensing a condition indicative of developer density and creating a first lower level of tension in the auger when the condition is indicative of the presence of a lower density and creating a higher level of tension when the condition is indicative of the presence of higher density developer. Examples of conditions that can be sensed include differences in humidity or the introduction of replenishment toner into the developer.

Also shown in the embodiment of FIG. 20, are the additional steps of sensing a rotational position of the first end, sensing a rotational position of the second end (step 414) and adapting the first force and the second force based upon the sensed rotational position of the first end and the sensed rotational position of the second end (step 416). These steps can be performed generally in the same manner described above with reference to FIG. 18. To the extent that auger controller 380 determines that the auger is to remain activated, this process can be repeated (step 418).

It will be appreciated that by providing a developer system and developer method having a dual drive auger system as described any of a number of potential technical effects can be achieved.

For example, the methods and development stations described herein enable a development system to include an auger having a volume that provides the first yield strength at the first end and the second yield strength end but that is less than the volume of the alternative auger providing the third yield strength so that more volume is available in development station for developer and replenishment toner than would be available if the alternative auger is used in the development station.

Similarly, the methods and development stations described herein enable a radius of an auger having the first yield strength and the second yield strength to be less than a radius of the alternative auger providing the third yield strength at the driven end, so that a volume of developer and replenishment toner moved by the auger creates less angular momentum than the alternative auger.

Additionally, the methods and development stations described herein can be used to enable a radius of a shaft of an auger that provides the first yield strength and the second yield strength to be less than a radius of an alternative shaft of the alternative auger that provides the third yield strength at a driven end, so that the auger provides less surface area for the developer and toner to act against to create drag than the alternative auger.

Additionally, the methods and development stations described herein can be used to enable a radius of an auger providing the first yield strength and the second yield strength is less than a radius of the alternative auger providing the third yield strength, so that the volume of a development station in which the auger operates can be made smaller than the volume of a development station in which the alternative auger operates while still moving and mixing a given volume of developer and replenishment toner. This can occur both because the radius of the auger is smaller and because the auger is tensioned so that it does not require as much space for axial curvature.

Further, the methods and development stations described herein can enable the volume of the shaft of an auger having the first yield strength and second yield strength to be made smaller than the volume of a shaft of an alternative auger having the third yield strength while using the same material for fabrication of the auger and for fabrication of the alternative auger. Thus this can enable a lighter and more cost effective development system and auger.

Still further, the methods and apparatuses described herein can enable an auger to be made from a first material that provides the first yield strength and second yield strength in a determined configuration, but must be made using a second material that is more dense than the first material to provide the third yield strength to make the alternative auger in the determined configuration. Similarly, the auger can be made from a first material that provides the first yield strength and second yield strength in a determined configuration, but must be made using a second material that is more rigid than the first material to provide the third yield strength to make the alternative auger in the determined configuration.

The invention has been described in detail with particular reference to certain preferred embodiments thereof, but it will be understood that variations and modifications can be effected within the scope of the invention.

What is claimed is:

1. A method for operating a development station, the method comprising the steps of:

applying a first force at a first end of an auger and a second force at a second end of the auger with the first force and the second force being sufficient to rotate the auger against a drag exerted by the developer and the replenishment toner;

wherein both the first force and the second force are less than a third force applied to a single driven end of an alternative auger to rotate the alternative auger against the drag and wherein the auger has a first yield strength at the first end and a second yield strength at the second end that are less than a third yield strength required to receive the third force at the driven end of the alternative auger.

2. The method of claim 1, wherein the volume of the auger providing the first yield strength at the first end and the second yield strength is less than the volume of the alternative auger providing the third yield strength so that more volume is available in development station for developer and replenishment toner than would be available if the alternative auger is used in the development station.

3. The method of claim 1, wherein a radius of the auger having the first yield strength and the second yield strength is less than a radius of the alternative auger providing the third yield strength at the driven end, so that a volume of developer and replenishment toner moved by the auger creates less angular momentum than the alternative auger.

4. The method of claim 1, wherein a radius of a shaft of the auger that provides the first yield strength and the second yield strength is less than a radius of an alternative shaft of the alternative auger that provides the third yield strength at a driven end, so that the auger provides less surface area for the developer and toner to act against to create drag than the alternative auger.

5. The method of claim 1, wherein a radius of the auger providing the first yield strength and the second yield strength is less than a radius of the alternative auger providing the third yield strength, so that the volume of a development station in which the auger operates can be made smaller than the volume of a development station in which the alternative auger operates while still moving and mixing a given volume of developer and replenishment toner.

6. The method of claim 1, wherein the volume of the shaft of an auger having the first yield strength and second yield strength can be made smaller than the volume of a shaft of an alternative auger having the third yield strength while using the same material for fabrication of the auger and for fabrication of the alternative auger.

7. The method of claim 1, wherein the auger can be made from a first material that provides the first yield strength and second yield strength in a determined configuration, but must be made using a second material that is more dense than the first material to provide the third yield strength to make the alternative auger in the determined configuration.

8. The method of claim 1, wherein the auger can be made from a first material that provides the first yield strength and second yield strength in a determined configuration, but must be made using a second material that is more rigid than the first material to provide the third yield strength to make the alternative auger in the determined configuration.

9. The method of claim 1, wherein the first force and the second force are applied to cause the first end of the auger and the second end of the auger to remain within a range of rotational positions relative to each other with the range being defined so that the differences in the rotational positions of the first end and the second end create a determined range of shear stress in the auger.

10. The method of claim 1, further comprising the step of conveying one of the first force and the second force from a side of the housing confronting one of the first end and the second end to another side of the housing confronting the other of the first end and the second end to drive the other of the first end and the second end without transmitting the conveyed force through the auger.

11. The method of claim 1, further comprising the steps of receiving an input force at a first end of the auger, distributing the input force into the first force and the second force, and conveying the second force along a path to the second end of the auger, with the path conveying the second force to the second end along a path outside of a housing of the development station.

12. The method of claim 11, wherein the path includes at least one of another auger, a toning shell, a magnetic core, a development roller, or a shaft in the development station that is mechanically linked to the second end of the auger for rotation therewith.

13. The method of claim 10, wherein the path includes a component of a photoconductor system that is adjacent to the development station.

14. The method of claim 1, wherein first force and the second force cause a difference in the rotational positions of the first end and the second end so that a first portion of the shear stress in the auger and the drag induces a second portion of the shear stress in the auger, and wherein the first force and the second force are applied so that the first portion is less than half of the total shear stress induced in the auger during rotation.

15. The method of claim 1, wherein the first force and the second force are applied to cause the first end and the second end to maintain a determined average rotational relationship over the course of each rotation of the auger.

16. The method of claim 1, wherein the first force and the second force are applied to cause the first end and the second end to maintain a determined average rate of rotation over the course of each rotation of the auger.

17. The method of claim 1, wherein the first force and the second force are applied to induce an amount of shear stress that creates an axial tension in the auger.

18. The method of claim 1, further comprising the step of receiving an input force and distributing the input force to provide the first force having a first portion of the input force to drive the first end and the second force having a second different portion of the input force to drive the second end of the auger.

19. The method of claim 1, further comprising the steps of sensing a rotational position of the first end, sensing a rotational position of the second end, and adapting the first force and the second force to control the extent to which the first end and the second end have different rotational positions.

20. The method of claim 1, wherein a flow of developer and replenishment toner moved by the auger is greater at one of the first end and the second end than the flow of developer and replenishment toner moved by the auger at the other of the first end and the second end so that a first component of the drag experienced at the first end of the auger is at a first level and so that a second component the drag experienced at the second end during rotation is at a second different level, and wherein the first force and the second force are in proportion to the component of the drag experienced at the first end and the second end.

21. A method for driving an auger in a developer station, the method comprising:

applying a first force at a first end of an auger and applying a second force at a second end of the auger with the first force and the second force being sufficient to rotate the auger against a drag exerted by a developer and a replenishment toner being moved by rotation of the auger; and, tensioning the auger along a length of the auger;

wherein both the first force and the second force are less than a third force applied to a single driven end of an alternative auger to rotate the alternative auger against the drag and wherein the auger has a first yield strength at the first end and a second yield strength at the second end that are less than a third yield strength required to receive the third force at the driven end of the alternative auger.

22. The method of claim 21, wherein the tension reduces an ability of the auger to flex perpendicular to an axis of rotation while rotating against the drag to reduce the extent of any drag caused by any increase in friction that can be experienced by the auger when the auger is allowed to flex perpendicular to an axis of rotation to an extent that is sufficient to bring the auger into contact with the development station so that additional drag will be created by frictional contact between the auger and the development station, or that is sufficient to bring the auger into close proximity to the development station such that frictional forces acting through the developer or replenishment toner increase the drag experienced by the auger.

23. The method of claim 21, wherein at least a portion of the tension reduces the extent of any curvature in the auger.

24. The method of claim 21, wherein the auger is tensioned by applying the first force to the first end such that a portion of the first force drives the first end away from the second end, and by applying the second force to the second end such that a portion of the second force drives the second force away from the first end.

25. The method of claim 24, further comprising the step of increasing the tension in the auger in proportion to the amount of the first force and the second force.

* * * * *